US007831189B2

(12) United States Patent
Harada et al.

(10) Patent No.: US 7,831,189 B2
(45) Date of Patent: Nov. 9, 2010

(54) LUBRICANT APPLYING UNIT, A PROCESS CARTRIDGE INCLUDING THE SAME, AND AN IMAGE FORMING APPARATUS PROVIDED WITH THE PROCESS CARTRIDGE INCLUDING THE SAME

(75) Inventors: Hiroomi Harada, Kawasaki (JP); Shuji Tanaka, Chigasaki (JP); Naohiro Kumagai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 962 days.

(21) Appl. No.: 11/625,672

(22) Filed: Jan. 22, 2007

(65) Prior Publication Data

US 2007/0172273 A1 Jul. 26, 2007

(30) Foreign Application Priority Data

Jan. 20, 2006 (JP) ..... 2006-011881
Jan. 23, 2006 (JP) ..... 2006-013336
Apr. 3, 2006 (JP) ..... 2006-101787

(51) Int. Cl.
*G03G 21/00* (2006.01)

(52) U.S. Cl. ..... 399/346; 399/343; 399/347

(58) Field of Classification Search ..... 399/346, 399/343, 347
See application file for complete search history.

(56) References Cited

U.S. PATENT DOCUMENTS 6,706,459 B2 * 3/2004 Kojima et al. ..... 430/119.8
2005/0025520 A1 * 2/2005 Murakami et al. ..... 399/111
2006/0067727 A1 3/2006 Suda et al.

FOREIGN PATENT DOCUMENTS

| | | |
|---|---|---|
| JP | 03-050562 | 3/1991 |
| JP | 09-062163 | 3/1997 |
| JP | 2000-075752 | 3/2000 |
| JP | 2000-162881 | 6/2000 |
| JP | 2002-244485 | 8/2002 |
| JP | 2002-351287 | 12/2002 |
| JP | 2005-208431 | 8/2005 |
| JP | 2005-309119 | 11/2005 |
| JP | 2005-321833 | 11/2005 |

OTHER PUBLICATIONS

U.S. Appl. No. 12/014,557, filed Jan. 15, 2008, Harada.
U.S. Appl. No. 12/046,827, filed Mar. 12, 2008, Ono, et al.

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

A lubricant applying unit, included in a process cartridge provided in an image forming apparatus, includes a solid lubricant, a lubricant supporting unit to support the solid lubricant, a lubricant holder to accommodate the solid lubricant supported by the lubricant supporting unit, a pressing mechanism located between the lubricant supporting unit and the lubricant holder and designed to press the solid lubricant against a lubricant applying member, and a frictional resistance reducing member to reduce a frictional resistance produced at sliding contact portions between the lubricant supporting unit and internal surfaces of the lubricant holder.

20 Claims, 15 Drawing Sheets

LUBRICANT APPLYING UNIT, A PROCESS CARTRIDGE INCLUDING THE SAME, AND AN IMAGE FORMING APPARATUS PROVIDED WITH THE PROCESS CARTRIDGE INCLUDING THE SAME

CROSS REFERENCE TO RELATED APPLICATIONS

The present application claims priority to Japanese patent applications no. 2006-011881, filed in the Japan Patent Office on Jan. 20, 2006, no. 2006-013336, filed in the Japan Patent Office on Jan. 23, 2006, and no. 2006-101787, filed in the Japan Patent Office on Apr. 3, 2006, the disclosures of each of which are incorporated by reference herein in their entirety.

BACKGROUND OF THE INVENTION

1. Field of the Invention

The present invention relates to a lubricant applying unit, a process cartridge including the lubricant applying unit, and an image forming apparatus provided with the process cartridge including the lubricant applying unit. More particularly, the present invention relates to a lubricant applying unit that applies a lubricant on a surface of an image bearing member and forms a thin layer of the lubricant, a process cartridge that includes the above-described lubricant applying unit, and an image forming apparatus that is provided with the process cartridge having the lubricant applying unit therein.

2. Discussion of the Related Art

Related art electrophotographic image forming apparatuses generally use a photoconductive method to form an electrostatic latent image on a surface of an image bearing member. An electrostatic force then adheres fine particles of toner and develops the electrostatic latent image to a visible toner image. Such related art image forming apparatuses that employ an electrophotographic image forming method generally include a lubricant applying unit that applies a lubricant on the surface of the image bearing member.

In a related art image forming apparatus, the lubricant applying unit may be used to eliminate problems that may be caused during a cleaning process. For example, the lubricant applying unit may solve problems when a cleaning brush or a cleaning blade remove residual toner remaining on the surface of the image bearing member after an image transferring operation has been performed. Specifically, the lives of an image bearing member and an intermediate transfer belt mainly depend on a degree of wear caused during the process in which the image bearing member and the intermediate transfer belt are in mechanical contact in a sliding manner with a cleaning brush or a cleaning blade of the image forming apparatus. Therefore, an operation of applying a lubricant on the respective surfaces of the image bearing member and the intermediate transfer belt can reduce a friction coefficient of the respective surfaces thereof and prevent the wear of the image bearing member and the intermediate transfer belt. Thus, the image bearing member and the intermediate transfer belt can obtain longer lives.

When the surface of the image bearing member is coated with a lubricant, the life of the image bearing member may become longer. In addition, as a friction coefficient of the surface of the image bearing member is reduced, foreign materials that are adhered to the surface of the image bearing member may easily be removed. That is, the application of the lubricant onto the surface of the image bearing member enables a cleaning brush or a cleaning blade to easily remove residual toner remaining on the surfaces of the image bearing member or of the intermediate transfer belt even after the transfer process has been completed.

Recently, substantially spherical toner manufactured by a polymerization method is commonly used for image forming. The substantially spherical toner can achieve a constant particle size distribution and a smaller spherical toner effectively, which can increase a level of image quality.

On the contrary, it is difficult to remove the substantially spherical toner adhered or remaining on the surface of the image bearing member.

From the above-described point of view, it may be important to employ a lubricant applying unit for applying a lubricant on a surface of an image bearing member to enhance a cleaning ability with respect to the surface of the image bearing member.

Generally, a solid lubricant may be applied to a surface of an image bearing member by a small amount in a powder form. By now, various techniques have been proposed to obtain better performance in the application of a lubricant as follows:

(1) A brush-type lubricant applying member rotates and scrapes a block-type solid lubricant so that the scraped lubricant in a powder form can be applied to the surface of the image bearing member.

(2) A lubricant is externally added to a toner particle. In this case, the amount of lubricant to be applied to the photoconductor may vary according to an image area to be output, and it is difficult to constantly apply a stable amount of lubricant for the entire surface of the image bearing member. Therefore, it is preferable to use a brush-type lubricant applying member to evenly apply a constant amount of lubricant to the entire surface of the image bearing member.

The above-described two techniques require a unit for applying a lubricant to an image bearing member. To maximize wear prevention and increase cleaning ability when the lubricant is applied to a surface of an image bearing member, it is important to control the amount and condition of the application of the lubricant. If a user wishes to enhance a lubricant's lubricating ability, the lubricant may be applied by an amount greater than a predetermined amount. However, an excess amount of lubricant may overflow and run out to adjacent units. For example, when an excess amount of lubricant enters into a charging unit, the amount of toner charge cannot properly be controlled. In addition, since recent image forming apparatuses and printers are becoming smaller in size, the elements and parts used therein are also required to be made smaller. Therefore, it is not desirable that an unnecessarily large-sized solid lubricant is provided to the small-sized image forming apparatuses and printers.

(3) A temperature of a surface of an image bearing member controls a pressure force of a solid lubricant with respect to the image bearing member and a rotation speed of a lubricant applying brush contacting the solid lubricant.

(4) An amount of a lubricant applied per rotary driving distance of the photoconductor is regulated.

(5) A number of rotations of a lubricant applying brush is controlled on the basis of image forming data.

(6) A user can avoid repurchasing an image forming apparatus when the user wishes to change the performance of the image forming apparatus. A plurality of types of engine units with different performance capabilities are respectively provided with nonvolatile memory units. The engine units in the image forming apparatus can be replaced. The image forming apparatus includes a control unit therein, by which the performance of the entire image forming apparatus is controlled on the basis of the information of the memory units in the installed engine units. This permits modifying the performance of the entire image forming apparatus, which relates to the recording rate and resolution or the like, simply by replacing the engine units with engine units that have different performance capabilities, even in the common image formation apparatus. The versatile and diversified types of machines can easily be handled.

(7) A lubricant applying unit that can ensure the control and uniformity of application quantity of the lubricant applied on a surface of a photoconductor is provided in a related art image forming apparatus. The lubricant applying unit includes a cleaning unit with a rotatable brush roller that is held in contact with a rotating image bearing member and applies a lubricant on the surface of the image bearing member, and a lubricant applying member that can be held in contact with or be separated from the rotatable brush roller. The lubricant is divided into a plurality of parts in a longitudinal direction thereof, and each of the parts can be held in contact with and can be separated from the rotatable brush roller.

(8) A proper amount of lubricant is economically applied to a surface of an image bearing member. In a related art image forming apparatus, a lubricant applying unit employing this technique includes a lubricant supplying part that is formed of a rotatable lubricant member and a lubricant, and a lubricant coating member that is rotated to coat the surface of the image bearing member with the supplied lubricant.

(9) Uneven coating caused by the tilt of the bristles of a lubricant applying brush is prevented by adjusting a pressuring force to the lubricant applying brush. A different related art image forming apparatus includes a lubricant applying member for applying a solid lubricant to a drum-shaped image bearing member that is equipped with a fur brush arranged between the drum-shaped image bearing member and the solid lubricant, so that the fur brush can scrape the solid lubricant to apply the scraped powder lubricant to a surface of the drum-shaped image bearing member, a pressuring member that is mounted on a lubricant case and includes a spring for pressing and energizing the solid lubricant to the fur brush, and a pressuring force changing means that is mounted on the lubricant case and previously includes a plurality of locations opposite to the solid lubricant to sandwich the spring so that the pressuring force of the spring can be changed by adjusting the plurality of locations.

However, the various techniques described above have not provided any technical thoughts to improve defects of a sliding performance between a lubricant supporting member, which supports a solid lubricant in a lubricant applying unit, and an internal surface of a lubricant holder, which accommodates the lubricant supporting member. This causes the solid lubricant to unevenly be pressed to a lubricant applying brush, which can easily cause variation in an amount of lubricant to be applied to a surface of an image bearing member.

Further, when an excess amount of lubricant is applied to the surface of the image bearing member, adjacent units such as a charging unit may easily be contaminated. On the contrary, when a smaller amount of lubricant is applied to the surface of the image bearing member, filming in which residual toner adheres to the surface of the image bearing member can easily be caused.

SUMMARY OF THE INVENTION

Exemplary aspects of the present invention have been made in view of the above-described circumstances.

Exemplary aspects of the present invention provide a novel lubricant applying unit that can effectively enhance a sliding performance of a lubricant by using at least one recyclable frictional resistance reducing member detachably engaged with a lubricant supporting member so that the tilting and uneven wear of the lubricant may be reduced or prevented.

Other exemplary aspects of the present invention provide a novel process cartridge that includes the above-described lubricant applying unit.

Other exemplary aspects of the present invention provide a novel image forming apparatus that includes the above-described process cartridge provided with the above-described lubricant applying unit.

In one exemplary embodiment, a novel lubricant applying unit includes a solid lubricant, a lubricant supporting unit configured to support the solid lubricant, a lubricant holder configured to accommodate the solid lubricant supported by the lubricant supporting unit, a pressing mechanism disposed between the lubricant supporting unit and the lubricant holder and configured to press the solid lubricant against a lubricant applying member, and a frictional resistance reducing member configured to reduce a frictional resistance produced at sliding contact portions between the lubricant supporting unit and internal surfaces of the lubricant holder.

The frictional resistance reducing member may include protruding portions disposed to at least one of the lubricant supporting unit and the lubricant holder.

The frictional resistance reducing member includes protruding portions and may be disposed to at least one of end portions and respective side portions of the lubricant supporting unit.

The frictional resistance reducing member may include a plurality of frictional resistance reducing portions, and at least one of the plurality of frictional resistance reducing portions may be formed in a line shape of sequential protruding portions along a sliding direction of the lubricant holder.

The frictional resistance reducing portion disposed to the end portions may be provided in a point contact manner with respect to the internal surfaces of the lubricant holder, and the frictional resistance reducing portion disposed to the respective side portions may be provided in a line contact manner with the sequential protruding portions, with respect to the internal surfaces of the lubricant holder along the sliding direction of the lubricant holder.

The at least one of the plurality of frictional resistance reducing portions formed in the line shape of sequential protruding portions along the sliding direction of the lubricant holder may be located laterally to end portions in an axial direction of the solid lubricant.

The at least one of the plurality of frictional resistance reducing portions formed in the line shape of sequential protruding portions along the sliding direction of the lubricant holder may be formed in a manner extending beyond an upper surface of the lubricant supporting unit and an upper surface of the lubricant holder.

The lubricant supporting unit may include a lubricant bearing member configured to bear the solid lubricant thereon, and at least one slide member configured to slide on the sliding contact portions, the at least one slide member includes the at least one frictional resistance reducing portion.

A friction coefficient of the lubricant bearing member "$\mu t$" and a friction coefficient of the at least one of slide members "$\mu s$" may have a relationship of $\mu t > \mu s$.

The slide member may detachably be engaged with the lubricant bearing member.

The frictional resistance reducing member includes the protruding portions that are provided on the lubricant holder and the frictional resistance reducing member may be provided at end portions of the internal surfaces of the lubricant holder.

The internal surfaces of the lubricant holder may include a first internal surface located at a downstream side of a rotation direction of the lubricant applying member, and the frictional resistance reducing member may be mounted on the first internal surface.

The internal surfaces of the lubricant holder may further include a second internal surface located at an upstream side of the rotation direction of the lubricant applying member, and the first internal surface with the frictional resistance reducing member mounted thereon may have substantially a same height as the second internal surface of the lubricant holder.

The lubricant applying member may include a rotatable brush member.

The frictional resistance reducing member may include a sheet-like metallic material.

The sheet-like metallic material may include a burred surface to face the internal surfaces of the lubricant holder.

The frictional resistance reducing member may include at least one folding portion having a L-shaped cross section in a direction perpendicular to a sliding direction of the solid lubricant.

The frictional resistance reducing member may include first and second sides connected at right angles of the folding portion, the first side having substantially a same length as an inner width of the lubricant holder; an end portion of the first side of the frictional resistance reducing member may be held in contact with a medial angle of the lubricant holder; the frictional resistance reducing member may be rotated with the end portion of the first side of the frictional resistance reducing member serving as a supporting point; the first side of the frictional resistance reducing member may contact a side regulating the inner width of the lubricant holder; and the frictional resistance reducing member may be attached to the end portion of the inner surface of the lubricant holder.

Further, in one exemplary embodiment, a novel process cartridge detachably attached to an image forming apparatus includes an image bearing member configured to bear an image thereon, at least one of a charging unit, a developing unit, and a cleaning unit, and the above-described novel lubricant applying unit.

Further, in one exemplary embodiment, a novel image forming apparatus includes an image bearing member configured to bear an image on a surface thereof, a charging unit configured to uniformly charge the image bearing member, a developing unit configured to develop an image formed on the image bearing member to a visible toner image, a cleaning unit configured to remove residual toner on the surface of the image bearing member, and the above-described novel lubricant applying unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
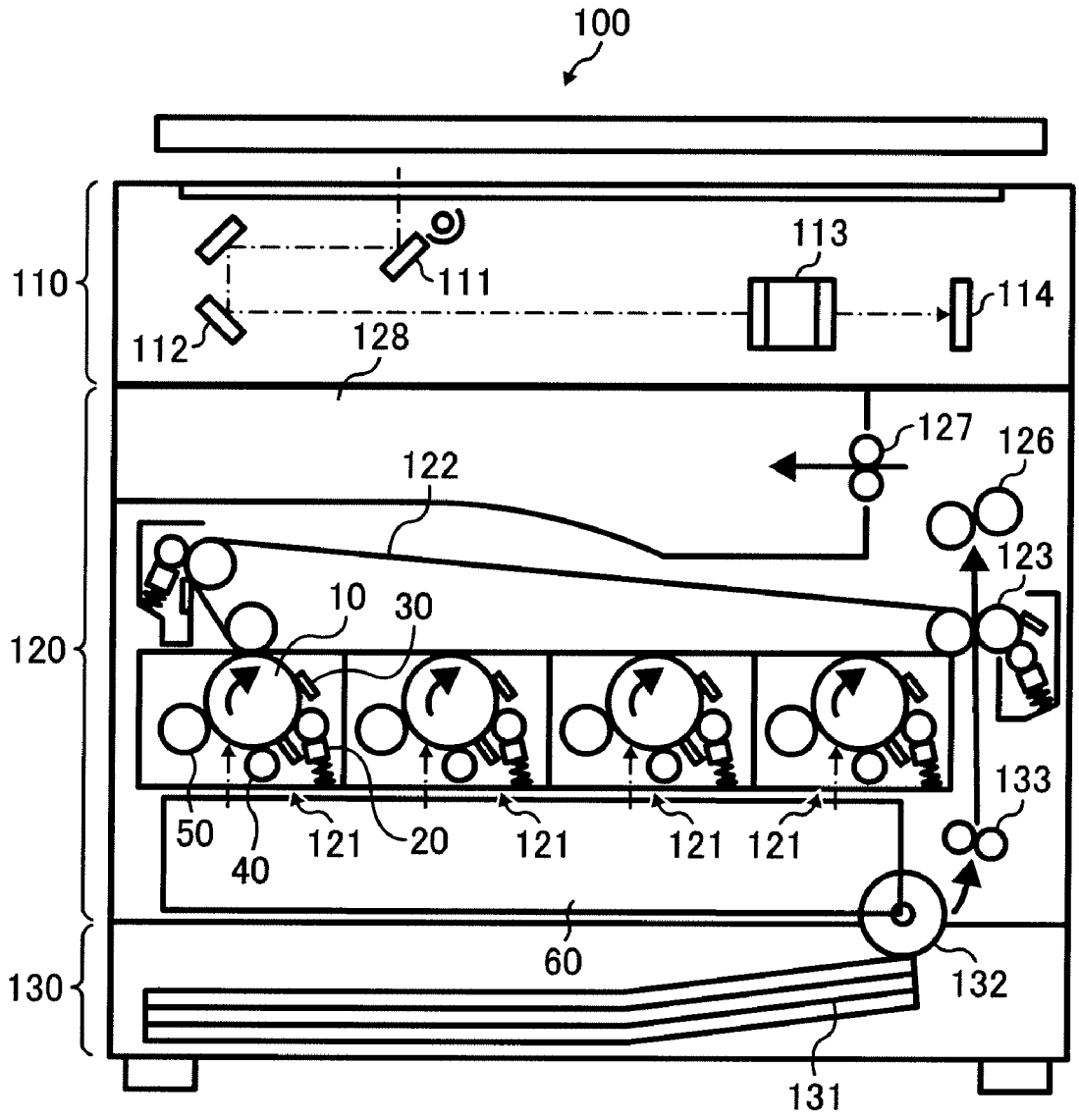
FIG. 1 is a schematic structure of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
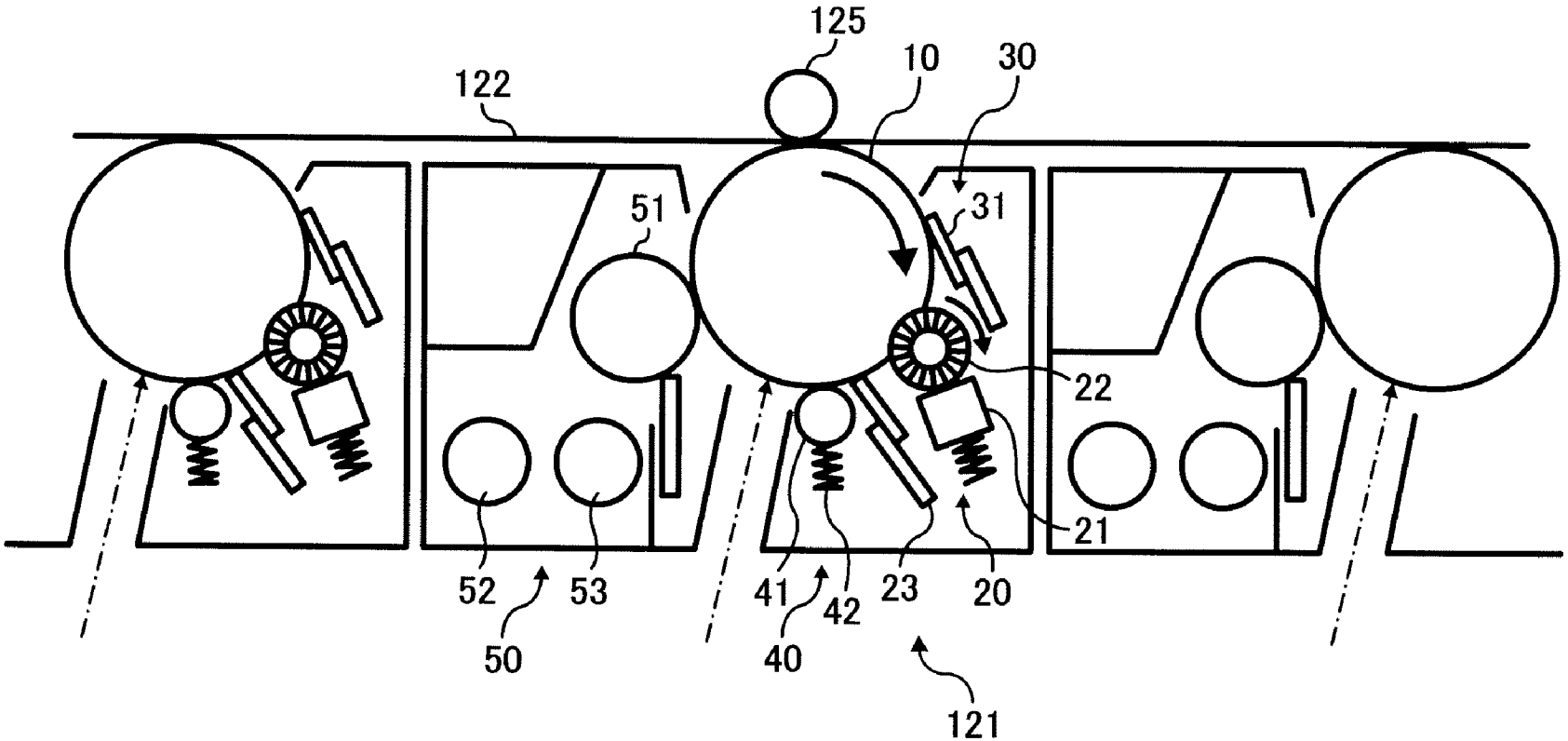
FIG. 2 is a schematic structure of a process cartridge, according to one exemplary embodiment of the present invention, provided in the image forming apparatus of FIG. 1.
Figure 3:
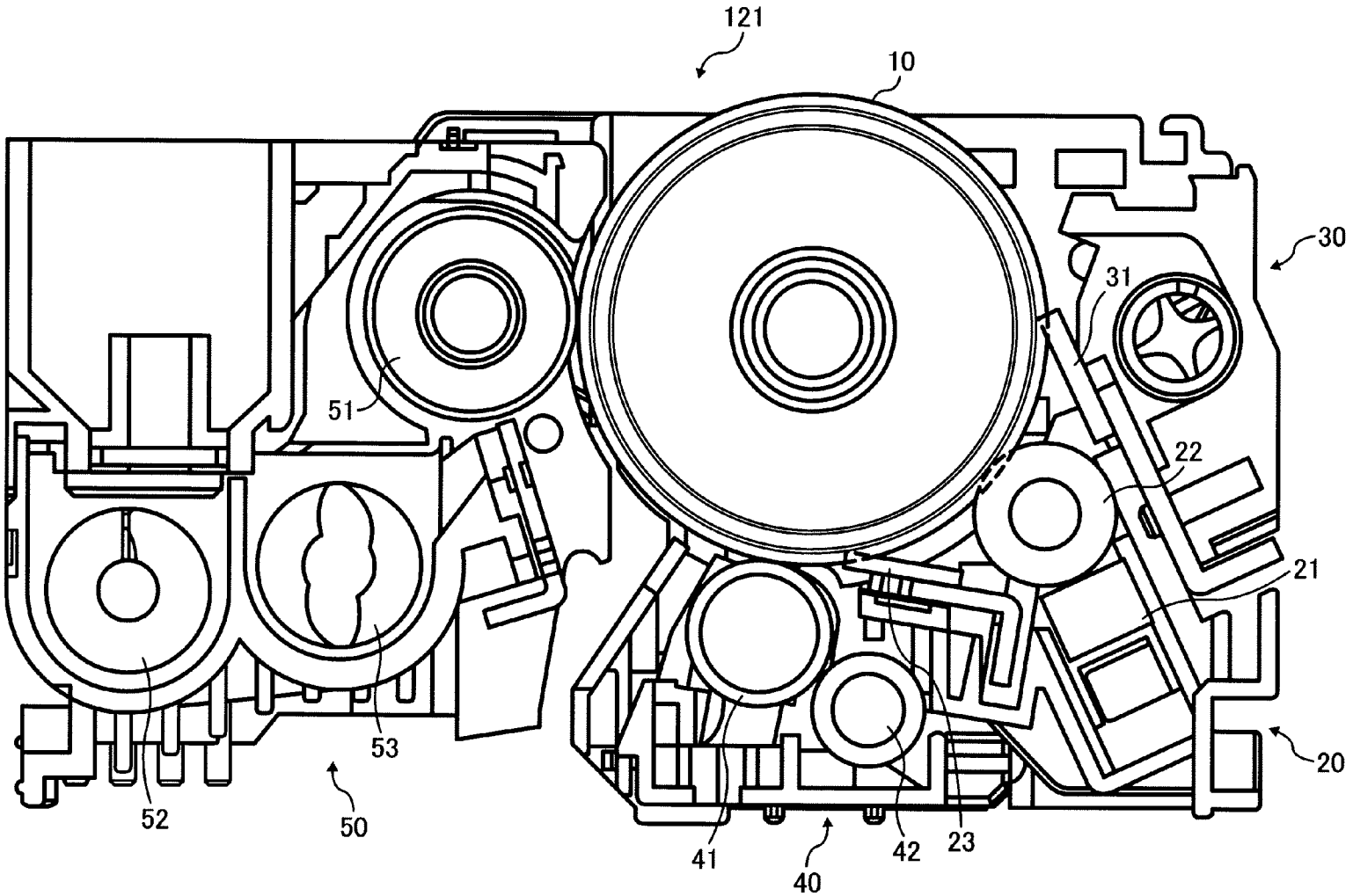
FIG. 3 is an enlarged diagram of the process cartridge of FIG. 2.

Referring to FIGS. 1, 2, and 3, a schematic entire structure and enlarged structures of an image forming apparatus 100 according to one exemplary embodiment of the present invention are described.

The image forming apparatus 100 of FIG. 1 may serve as a full-color image forming apparatus and include an image reading mechanism 110, an image forming mechanism 120, and a sheet feeding mechanism 130.

The image reading mechanism 110 includes a first moving member 111, a second moving member 112, an image forming lens 113, and an image reading sensor 114.

The image forming mechanism 120 includes four process cartridges 121, an intermediate transfer belt 122, a secondary transfer roller 123, and toner bottles (not shown).

Each of the four process cartridges 121 may include a photoconductor 10 serving as an image bearing member, and other image forming components such as a lubricant applying unit 20, a cleaning unit 30, a charging unit 40, and a developing unit 50. The above-described image components are disposed around the photoconductor 10 in the order of the cleaning unit 30, the lubricant applying unit 20, the charging unit 40, and the developing unit 50 according to the image forming operations.

Since the four process cartridges 121 have similar structures and functions, except that respective toners are different colors, which are yellow, cyan, magenta, and black. Therefore, the explanations below focus on the functions of and operations performed by one of the four process cartridges 121, especially in FIGS. 2 and 3.

The toner bottles, which are not shown, may accommodate the above-described respective toners of different colors therein, and supply the respective toners to the respective process cartridges 121.

The intermediate transfer belt 122 may be made in a form of an endless belt and serve as a transfer member. The intermediate transfer belt 122 may receive each single color image thereon from the photoconductor 10 to form an overlaid toner image, and carry the overlaid toner image to be transferred onto a recording medium. The intermediate transfer belt 122 may be disposed above the photoconductor 10 of each of the process cartridges 121. An outer surface of the lower portion of the intermediate transfer belt 122 may be held in contact with a surface of the photoconductor 10.

A primary transfer roller 125 shown in FIG. 2 may be disposed to face the photoconductor 10 and sandwich the intermediate transfer belt 122 with the surface of the photoconductor 10.

An optical writing unit 60 may be disposed below the four process cartridges 121. The optical writing unit 60 may emit a laser light beam according to image data and irradiate a charged surface of the photoconductor 10 so that an electrostatic latent image can be formed on the surface of the photoconductor 10.

The intermediate transfer belt 122 and the secondary transfer roller 123 may include respective lubricant applying units on the respective surfaces thereof. Further, respective cleaning units are mounted to be arranged adjacent to the lubricant applying units.

The sheet feeding mechanism 130 may include a sheet feeding cassette 131 and a sheet feeding roller 132.

The sheet feeding cassette 131 may accommodate transfer sheets serving as recording media.

The sheet feeding roller 132 may guide a transfer sheet fed from the sheet feeding cassette 131 toward a pair of registration rollers 133.

The pair of registration rollers 133 may stop and feed the transfer sheet in synchronization with a movement of the intermediate transfer belt 122. The transfer sheet may be conveyed at a predetermined timing toward a secondary nip formed between the intermediate transfer belt 122 and the secondary transfer roller 123.

A fixing unit 126 may be disposed in the vicinity of a sheet discharging portion 128 of the image forming apparatus 100. After the fixing unit 126 has fixed the toner image on the transfer sheet, the transfer sheet may pass through a pair of sheet discharging rollers 127 to the sheet discharging portion 128 that holds a stack of discharged sheets.

As shown in FIGS. 2 and 3, the cleaning unit 30 of the process cartridge 121 may include a cleaning blade 31. The cleaning blade 31 may be held in contact with the surface of the photoconductor 10 and remove residual toner remaining on the surface of the photoconductor 10.

Figure 5:
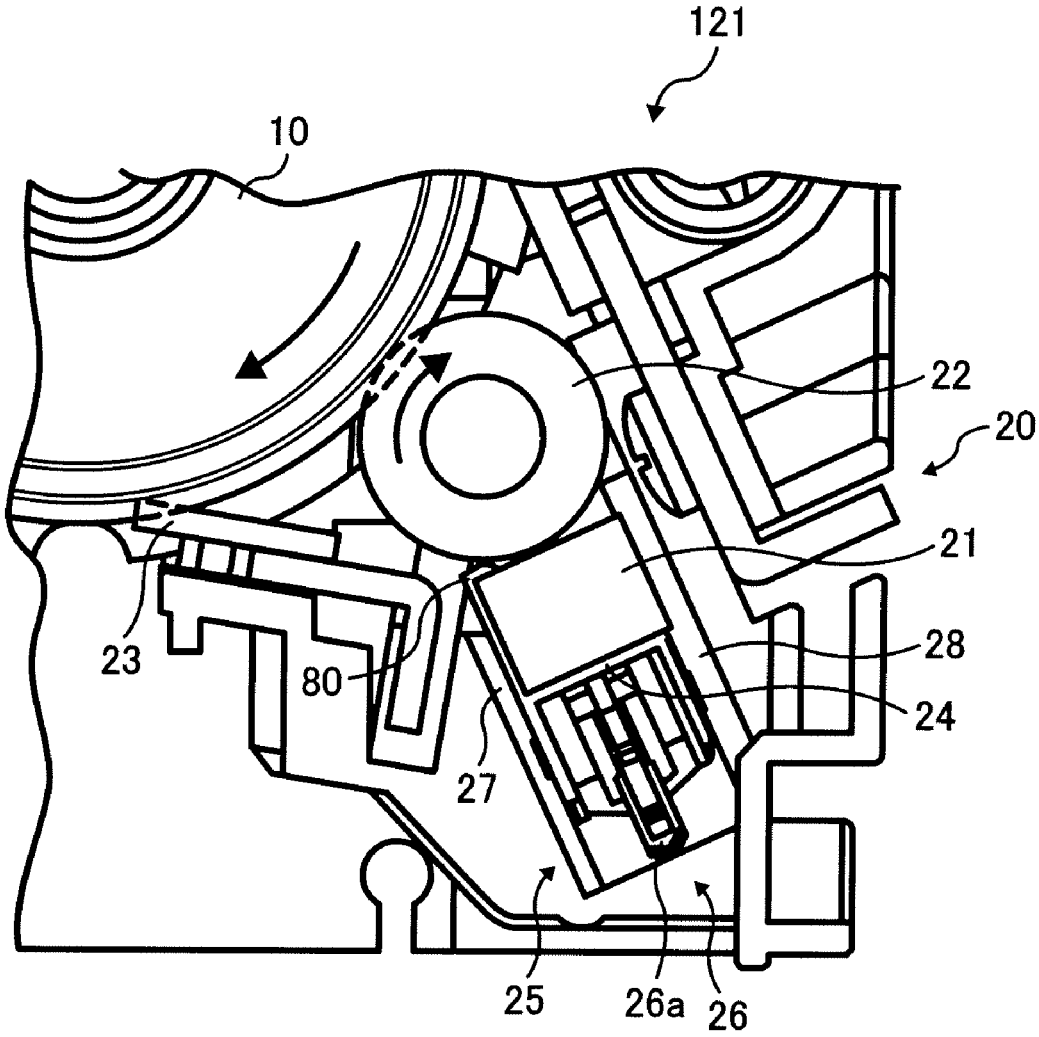
FIG. 5 is an enlarged cross sectional view of a lubricant applying unit provided to the process cartridge of FIGS. 2 and 3.

The lubricant applying unit 20 of the process cartridge 121 may include a solid lubricant 21, a brush roller 22, a lubricant regulating blade 23, and a pressing mechanism 26 (see FIG. 5).

The brush roller 22 may be disposed between the solid lubricant 21 and the photoconductor 10, and may rotate in a direction indicated by an arrow in FIG. 2 while contacting both the solid lubricant 21 and the photoconductor 10. The brush roller 22 may scrape the solid lubricant 21 and apply lubricant powder scraped from the solid lubricant 21 in a powder form onto the surface of the photoconductor 10.

The lubricant regulating blade 23 may regulate the height of the scraped lubricant in a powder form applied on the surface of the photoconductor 10.

The pressing mechanism 26 may press the solid lubricant 21 against the brush roller 22.

The charging unit 40 may include a charging roller 41 and a biasing member 42.

The charging roller 41 may be disposed to contact the photoconductor 10 so as to uniformly charge the surface of the photoconductor 10.

The biasing member 42 may press the charging roller 41 against the photoconductor 10.

The developing unit 50 may include a developing roller 51, a mixing roller 52, and a developer supplying roller 53.

The developing roller 51 may supply toner on the surface of the photoconductor 10 so as to develop the electrostatic latent image into a visible toner image.

The mixing roller 52 may agitate developer that is accommodated in a developer accommodating portion (not shown).

The developer supplying roller 53 may supply the developer, which is agitated and mixed in the developer accommodating portion, to the developing roller 51.

Figure 4:
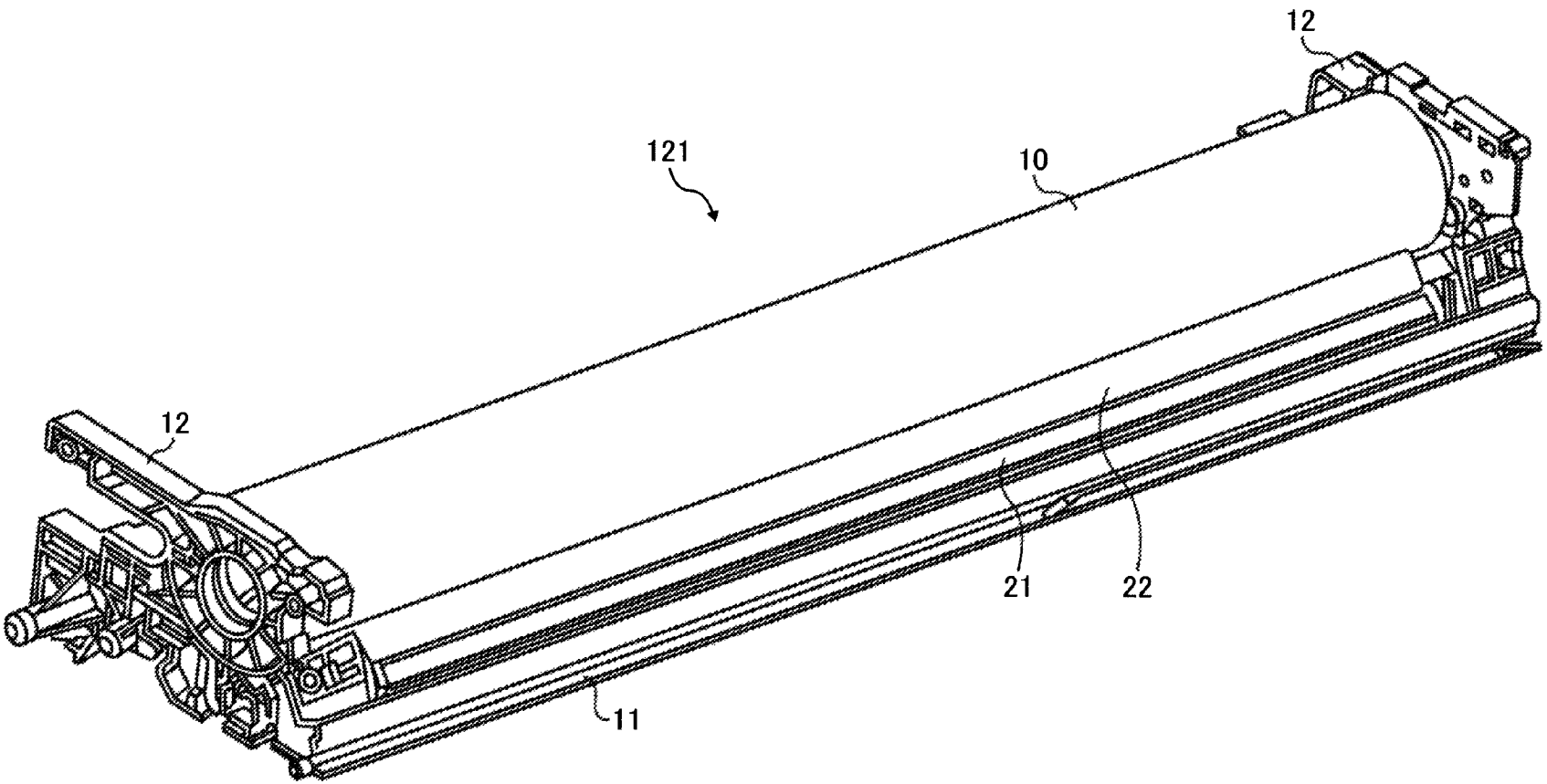
FIG. 4 is a perspective entire view of the process cartridge of FIGS. 2 and 3.

Referring to FIG. 4, an entire external view of the process cartridge 121 of FIGS. 2 and 3.

In FIG. 4, the process cartridge 121 includes a housing 11 and side plates 12 disposed at respective end portions of the housing 11. The solid lubricant 21 and the brush roller 22 may be disposed between the side plates 12.

Referring to FIG. 5, an enlarged part of the lubricant applying unit 20 is described.

As shown in FIG. 5, the lubricant applying unit 20 may include the solid lubricant 21, a lubricant supporting unit 24, and a lubricant holder 25.

The lubricant supporting unit 24 may support the solid lubricant 21. Specifically, the solid lubricant 21 may integrally be supported by the lubricant supporting unit 24, and be biased by a spring **26*b* (see FIGS. 11C and 11F) of the pressing mechanism 26 toward the brush roller 22. A top surface of the solid lubricant 21 may be held in contact with the brush roller 22**.

The lubricant holder 25 may accommodate the lubricant supporting unit 24 with the solid lubricant 21 mounted thereon. The lubricant holder 25 may have internal surfaces 27 and 28, both of which may run in a longitudinal direction of the lubricant holder 25.

The internal surface 27 may be disposed at a downstream side of a rotation direction of the brush roller 22, with respect to a contact portion of the solid lubricant 21 and the brush roller 22, and the internal surface 28 may be disposed at an upstream side of the rotation direction thereof. The internal surface 27 may have a SUS plate 80 serving as a frictional resistance reducing member. Details of the internal surfaces 27 and 28 and the SUS plate 80 will be described later.

The lubricant applying unit 20 may be provided with the pressing mechanism 26 in the process cartridge 121. The pressing mechanism 26 may include a pair of cams 26*a* and the spring 26*b*, and be disposed between the lubricant supporting unit 24 and the lubricant holder 25. The pair of cams 26*a* may be arranged with a predetermined gap therebetween. Details of the pressing mechanism 26 may be described later.

Figure 6:
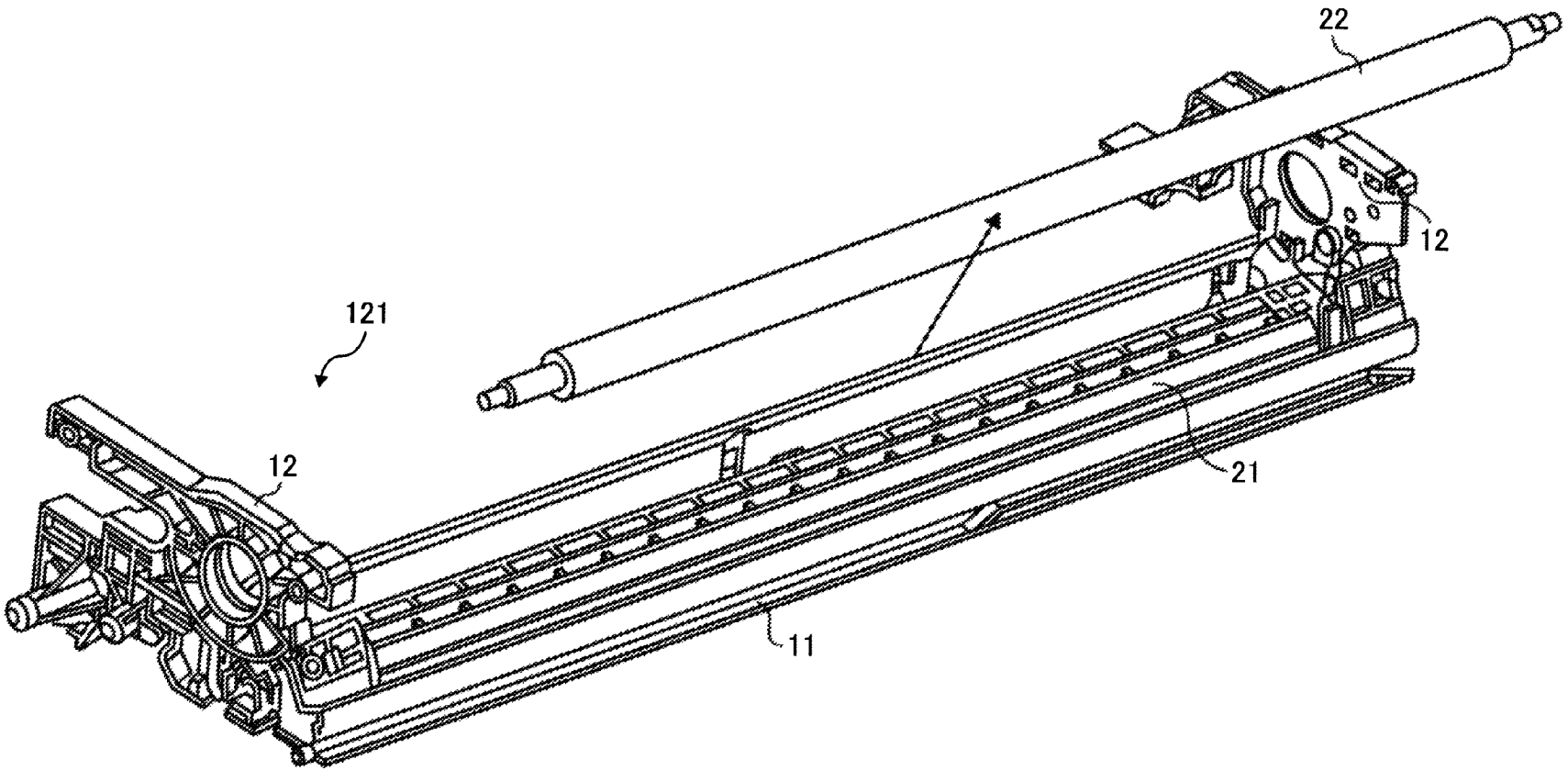
FIG. 6 is an exploded view of the process cartridge of FIGS. 2 and 3.
Figure 7:
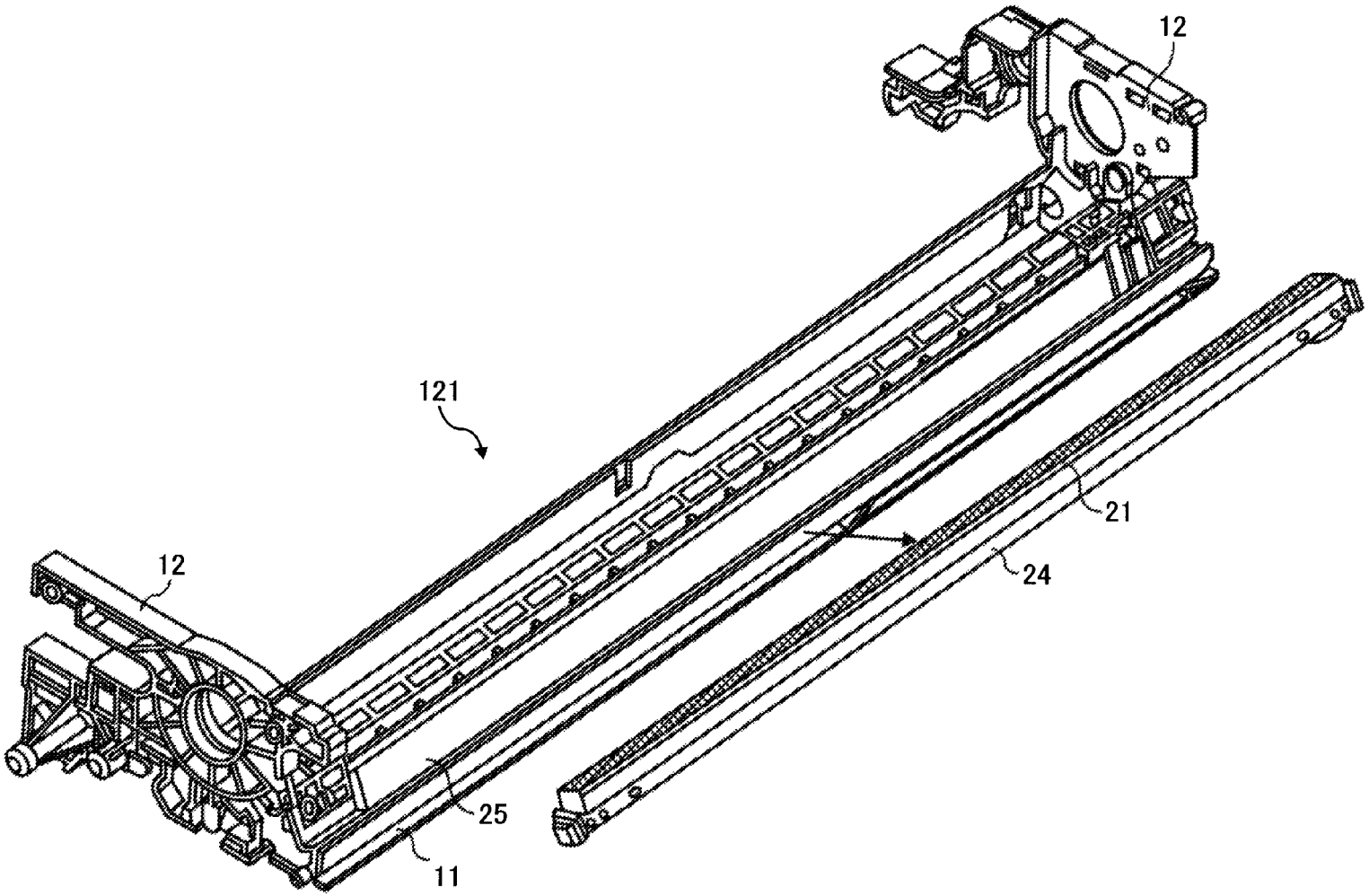
FIG. 7 is another exploded view of the process cartridge of FIGS. 2 and 3.

Referring to FIGS. 6 and 7, schematic structures in the exploded views of the process cartridge 121 are described.

As shown in FIG. 6, the brush roller 22 may be detachably supported between the side plates 12 that are disposed at respective ends of the housing 11. The brush roller 22 can be detached as indicated by an arrow in FIG. 6.

As shown in FIG. 7, the lubricant supporting unit 24 with the solid lubricant 21 that is integrally supported by and mounted on the lubricant supporting unit 24 may be accommodated in the lubricant holder 25 included in the housing 11 of the lubricant applying unit 20. The lubricant supporting unit 24 with the solid lubricant 21 mounted thereon can be detached as indicated by an arrow in FIG. 7. With the above-described structure, the solid lubricant 21 may be arranged to slidably be moved by a restoring force exerted by the above-described spring 26*b* between the pair of cams 26*a*.

Figure 8:
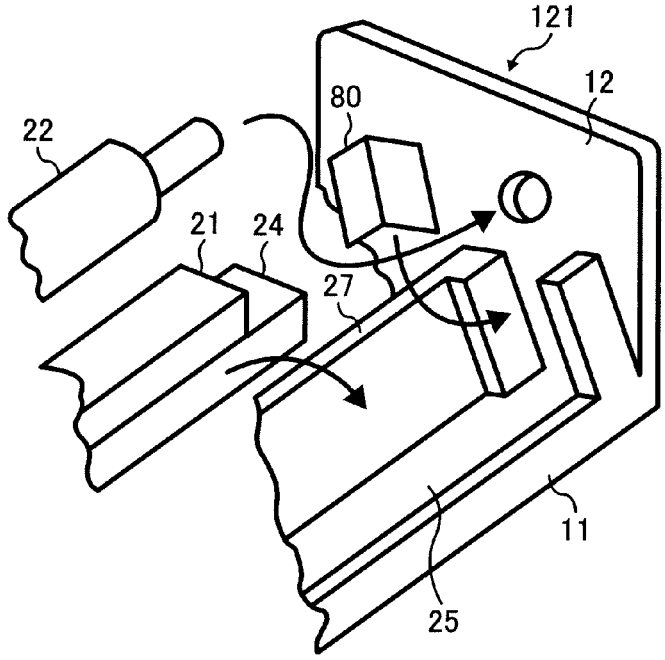
FIG. 8 is an enlarged exploded view of a portion of the lubricant applying unit of FIG. 5.
Figure 9:
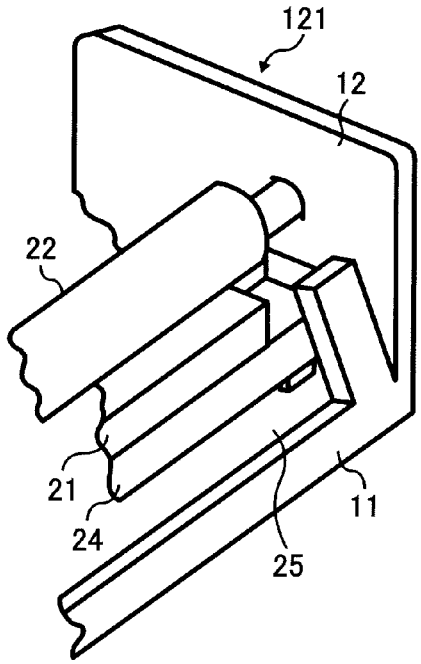
FIG. 9 is an enlarged view of the portion of the lubricant applying unit of FIG. 8.

Referring to FIGS. 8 and 9, assembly drawings of the process cartridge 121 are described.

FIG. 8 shows the process cartridge 121 before mounting the brush roller 22 and the solid lubricant 21. FIG. 9 shows the process cartridge 121 after the brush roller 22 and the solid lubricant 21 have been mounted thereon.

As shown in FIGS. 4, 6, and 7, the process cartridge 121 includes two side plates. When either one of the side plates 12 is not shown, like in FIGS. 8 and 9, the side plates 12 are described in a singular form as a "side plate 12." However, it is noted that both of the side plates 12 have the identical structure and function.

The lubricant holder 25 may be included in the housing 11 of the process cartridge 121 so as to support and accommodate the lubricant supporting unit 24 with the solid lubricant 21 mounted thereon.

As previously described, the biasing member 26 may press the solid lubricant 21 against the brush roller 22 serving as a lubricant applying member. The biasing member 26 may be disposed between a lubricant mounting surface of the lubricant holder 25 and a bottom surface of the lubricant supporting unit 24.

The housing 11 forming the lubricant holder 25 thereon may be made of a material that is combined with a resin material and a hardening agent. For example, a mix material including a polyacetal or polycarbonate resin and a filler as a hardening agent may be used.

The lubricant holder 25 may be formed in a shape of an elongated rectangular box. The short side of the lubricant holder 25 and a portion of the internal surface 27 that contacts with the short side of the lubricant holder 25 may be covered by the SUS plate 80.

The SUS plate 80 may serve as a frictional resistance reducing member and be made of a stainless plate. The SUS plate 80 may be mounted on the internal surface 27 of the lubricant holder 25 so as to reduce frictional resistance produced at a sliding contact portion between the lubricant supporting unit 24 and the internal surface 27 of the lubricant holder 25. The SUS plate 80 may include a burred surface at cut end portions thereof and be disposed to face the internal surface 27 of the lubricant holder 25, for example. By disposing the burred surface of the SUS plate 80 facing the internal surface 27 of the lubricant holder 25, the frictional resistance produced at the sliding contact portion between the lubricant supporting unit 24 and the internal surface 27 of the lubricant holder 25 can be reduced or prevented, if possible.

As shown in FIG. 9, the lubricant holder 25 formed on the housing 11 may accommodate the solid lubricant 21 being supported by the lubricant supporting unit 24. The brush roller 22 that is rotatably supported between the side plates 12 may press the solid lubricant 21 supported by the lubricant supporting unit 24 and the pressing mechanism 26.

Now, image forming operations performed by the image forming apparatus 100 having the process cartridge 121 with the lubricant applying unit 20 mounted therein, according to at least one exemplary embodiment of the present invention, are described below.

At the start of the image forming operations, the photoconductor 10 integrally mounted in the process cartridge 121 may be rotated in a clockwise direction indicated by arrows shown in FIG. 1 and FIG. 2. The charging roller 41 of the charging unit 40 may uniformly charge the surface of the photoconductor 10 to a predetermined polarity.

After the photoconductor 10 has been charged, the optical writing unit 60 may emit, for example, a modulated laser light beam to the surface of the photoconductor 10 so as to form an electrostatic latent image on the surface of the photoconductor 10. The developing unit 50 may supply a developer corresponding to a color according to image data and develop the electrostatic latent image to a visible single toner image.

A transfer voltage may be applied to the primary transfer roller 125 so that the single toner image formed on the surface of the photoconductor 10 may be transferred onto a surface of the intermediate transfer belt 122. Respective single toner images of different colors may sequentially be transferred onto the intermediate transfer belt 122 to form an overlaid color toner image.

The overlaid color toner image on the intermediate transfer belt 122 may further be conveyed and transferred onto a recording sheet.

The recording sheet may be fed at a predetermined timing by the sheet feeding roller 132 of the sheet feeding mechanism 130 and may be stopped and fed by the pair of registration rollers 133 in synchronization of the movement of the intermediate transfer belt 122. When the recording sheet is conveyed to the secondary nip formed between the intermediate transfer belt 122 and the secondary transfer roller 123, the color toner image may be transferred from the intermediate transfer belt 122 to the recording sheet.

The recording sheet with the color toner image thereon may be fed to the fixing unit 126. The fixing unit 126 may fix the color toner image onto the recording sheet by applying heat and pressure.

After the fixing unit 126 has fixed the color toner image to the recording sheet, the recording sheet may be conveyed to the sheet discharging portion 128 by the pair of sheet discharging rollers 127.

After the toner image has been transferred to the intermediate transfer belt 122, the cleaning unit 30 may remove residual toner remaining on the surface of the photoconductor 10 by using the cleaning blade 31.

After the cleaning unit 30 has removed the residual toner on the surface of the photoconductor 10, the lubricant applying unit 20 may apply lubricant on the surface of the photoconductor 10.

Referring to FIGS. 10A through 10D and FIGS. 11A through 11F, detailed structures and functions of the lubricant supporting unit 24 of the lubricant applying unit 20 according to one exemplary embodiment of the present invention are described.

Figure 10A:
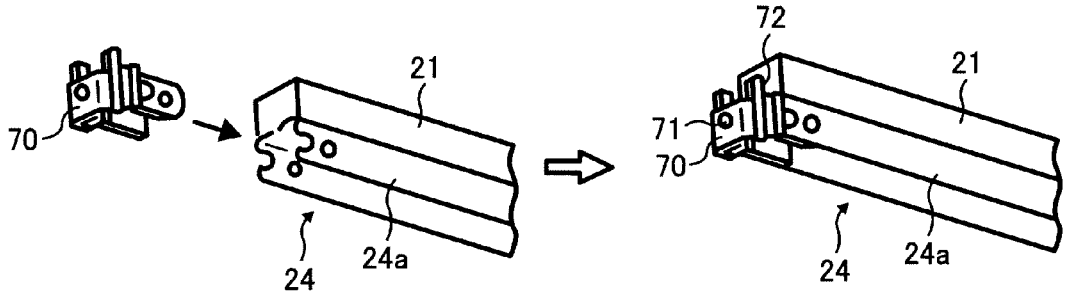
FIG. 10A is a perspective partial view of a lubricant supporting member provided to the lubricant applying unit of FIGS. 8 and 9.
Figure 10B:
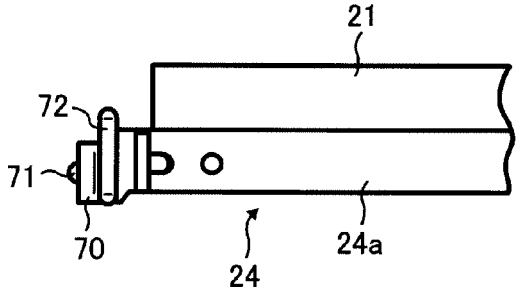
FIG. 10B is a lateral partial view of the lubricant supporting member of FIG. 10A in a longitudinal direction thereof.
Figure 10C:
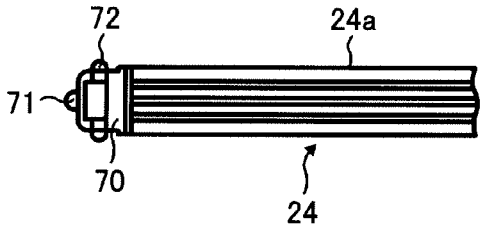
FIG. 10C is a bottom plan view of the lubricant supporting member of FIG. 10A.
Figure 10D:
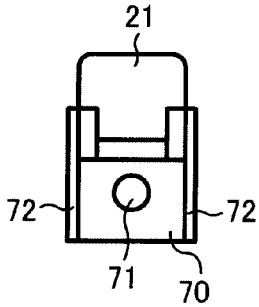
FIG. 10D is a front view of the lubricant supporting member of FIG. 10A.

FIG. 10A is a perspective view of one end portion of the lubricant supporting unit 24 of the lubricant applying unit 20, FIG. 10B is a side view thereof, FIG. 10C is a rear or bottom surface view thereof, and FIG. 10D is a front view thereof.

In FIGS. 10A through 10D, the lubricant supporting unit 24 may include a main body 24*a*, attached with a pair of slide members 70, each of the slide members 70 including protruding portions 71 and 72 thereon.

The main body 24*a* of the lubricant supporting unit 24 may serve as a lubricant carrying member and mainly include a metallic material such as a zinc coated steel plate or galvanized steel iron.

The pair of slide members 70 may be respectively disposed at both end portions of the lubricant supporting unit 24 and be detachably engaged with the respective end portions of the main body 24*a* of the lubricant supporting unit 24. The slide member 70 may mainly include a resin, for example, a polyacetal resin.

By including a resin, for example, a polyacetal resin, the slide member 70 can be molded more flexibly in molding and can slide more smoothly on the internal surface 27 of the lubricant holder 25.

When either one of the pair of slide members 70 is not shown, like in FIGS. 10A through 10D and FIGS. 11A through 11F, the pair of slide members 70 is described in a singular form as a "slide member 70." However, it is noted that the pair of slide members 70 have the identical structure and function.

The slide member 70 may be made of a resin material and serve as a member that slidably contacts with an internal surface 27 of the lubricant holder 25.

The slide member 70 may detachably be engaged with the main body 24*a* of the lubricant supporting unit 24 by using, for example, an adhesion method such as thermal caulking, double-stick tape, and hot melt, and/or a press fitting method, and so forth. In at least one exemplary embodiment of the present invention, the slide member 70 may be detachably engaged with the main body 24*a* by using a snap fitting method so that the components are easy to use and can be recycled and reused.

Since the lubricant supporting unit 24 may include the main body 24*a* thereof and the slide member 70, the lubricant applying unit 20 can include the lubricant supporting unit 24 that has excellent recycling efficiency.

The slide member 70 may have three sides, one of which being an end face facing the lubricant supporting unit 24 in a direction perpendicular to an axial or longitudinal direction of the lubricant supporting unit 24 and the others of which being side faces facing each other and sandwiching predetermined side portions of the lubricant supporting unit 24 in the vicinity of the end portion of the lubricant supporting unit 24 along the axial or longitudinal direction.

The protruding portion 71 may be formed on a surface of the end face of the slide member 70 in a form of a semicircular arc shape in its lateral cross-sectional profile or a semispherical cross-sectional profile. The protruding portion 71 may serve as a frictional resistance reducing portion to support the lubricant supporting unit 24 in the axial or longitudinal direction of the lubricant supporting unit 24.

The protruding portion 71 may face a corresponding end portion of the lubricant supporting unit 24, in a direction perpendicular to the axial or longitudinal direction of the lubricant supporting unit 24.

The protruding portions 72 may be formed on respective surfaces of the side faces of the slide member 70 in a form of a semi-cylindrical shape. The protruding portions 72 may serve as a frictional resistance reducing portion to support the lubricant supporting unit 24 along the axial or longitudinal direction thereof. The protruding portions 72 may support the lubricant supporting unit 24 by sandwiching the predetermined side portions of the lubricant supporting unit 24 in the vicinity of the end portion of the lubricant supporting unit 24 along the axial or longitudinal direction, such that a ridge line of the protruding portions 72 may extend in a sliding direction toward a bottom surface of the lubricant holder 25, which is a downward direction in FIG. 10A.

The protruding portion 71, which represents the frictional resistance reducing portion formed on the surface of the end face of the slide member 70, may support the lubricant supporting unit 24 in the longitudinal direction thereof. This support may not directly affect an operation of applying the solid lubricant 21 to the photoconductor 10. Therefore, the protruding portion 71 may be kept in a point contact manner against the internal surface 27 of the lubricant holder 25 to reduce the frictional resistance.

On the other hand, the protruding portions 72, which also represent the frictional resistance reducing portions formed on the respective surfaces of the side faces of the slide member 70, may directly affect the operation of applying the solid lubricant 21 to the photoconductor 10. Therefore, the protruding portions 72 may be kept in a line contact manner against the internal surface 27 of the lubricant holder 25 so as to prevent a tilt of the solid lubricant 21 caused along with a rotation of the brush member 22 and to stably support the solid lubricant 21 on the lubricant supporting unit 24.

If the protruding portions 72 that support the surfaces of the side faces of the slide member 70 are kept in a point contact manner, as is the protruding portion 71, the solid lubricant 21 supported by and mounted on the lubricant supporting unit 24 may easily tilt toward a rotation direction of the brush roller 22. Additionally, the slide member 70 cannot support the solid lubricant 21 and the lubricant supporting unit 24 stably. Under this condition, a contact angle formed between the upper surface of the solid lubricant 21 that is supported by the lubricant supporting unit 24 and the brush roller 22 may become unstable. This may easily cause an uneven wear of the solid lubricant 21 so that a constant amount of lubricant may not be applied to the surface of the photoconductor 10.

On the other hand, when the protruding portion 71 is formed in a semi-cylindrical shape, as are the protruding portions 72, a sufficient effect of reducing the friction resistance may not be obtained.

Therefore, in at least one exemplary embodiment of the present invention, only the protruding portions 72 that are mounted on the surfaces of the side faces of the slide member 70 may be formed in a semi-cylindrical shape with a predetermined length. With the above-described structure, while the frictional resistance that may be produced between the lubricant supporting unit 24 and the internal surface 27 of the lubricant holder 25 is reduced, the solid lubricant 21 may stably be supported all through the life thereof.

The protruding portions 72 of the slide member 70, which may support the predetermined side portions of the lubricant supporting unit 24 in the vicinity of the end portion of the lubricant supporting unit 24, may be arranged laterally to the end portion of the solid lubricant 21, which is the left side of the solid lubricant 21 in FIG. 10B. For example, two of the protruding portions 72, each of which having a semi-cylindrical shape, are disposed on respective predetermined side portions of the lubricant supporting unit 24 and may be located laterally to the end portion of the solid lubricant 21. One of the protruding portions 72 mounted on the other end portion of the lubricant supporting unit 24 is omitted in FIG. 10B.

A distance between the respective protruding portions 72 of the pair of slide members 70 may be arranged to be greater than a length of the solid lubricant 21 in the axial direction thereof and greater than that of the brush roller 22 which has substantially the same length as the solid lubricant 21.

With the above-described structure, even when the entire position of the lubricant supporting unit 24 becomes closer to the brush roller 22 because of the consumption of the solid lubricant 21, the protruding portions 72 can avoid colliding with the brush roller 22. Thereby, a constant amount of the solid lubricant 21 may be applied to the surface of the photoconductor 10. At the same time, the above-described structure can reduce or prevent, if possible, attachment or adhesion of a lubricant in a powder form scraped from the solid lubricant 21 by the brush roller 22 on a sliding contact portion between the lubricant supporting unit 24 and the internal surface 27 of the lubricant holder 25. Thus, a smooth sliding performance at the sliding contact portion can be obtained.

Further, each upper end portion of the protruding portions 72 may extend in an upward direction beyond an upper surface of the lubricant supporting unit 24. That is, the protruding portions 72 extending with a predetermined length may constantly support both end portions of the lubricant supporting unit 24. Therefore, the lubricant supporting unit 24 can constantly be disposed at a correct position with respect to the brush roller 22. With the above-described structure, the solid lubricant 21 may be evenly consumed. Thus, the stable amount of lubricant may be applied to the surface of the photoconductor 10.

According to at least one exemplary embodiment of the present invention, the protruding portion 71 in the form of a semicircular arc shape may be formed on the end face of the slide members 70 to be detachably engaged with the corresponding end portion of the lubricant supporting unit 24. Further, the protruding portions 72 in the form of a semicylindrical shape may be formed on the side faces of the slide member 70 to support the side surfaces of the lubricant supporting unit 24, which are respectively in the vicinity of the end portions thereof. By mounting the protruding portions 71 and 72 as described above, the frictional resistance generated when the lubricant supporting unit 24 contacts and slides on the internal surface 27 of the lubricant holder 25 may be reduced. Thereby, the lubricant supporting unit 24 can become more effective in a sliding operation and the solid lubricant 21 supported by the lubricant supporting unit 24 can be evenly pressed against the brush roller 22. This can reduce or prevent an uneven wear of the solid lubricant 21. Therefore, the application of a stable amount of lubricant to the photoconductor 10 can be obtained so as to effectively use the solid lubricant 21 until the end of its life. In addition, the contamination to the adjacent units and/or members due to an excess amount of lubricant and the filming due to the application of a small amount of lubricant can be reduced or prevented.

According to at least one exemplary embodiment of the present invention, the protruding portions 72 having a semicylindrical shape may be formed in an extending manner beyond the upper surface of the lubricant supporting unit 24. With this structure, the solid lubricant 21 may constantly be supported in a stable manner over a range greater than the longitudinal length of the solid lubricant 21. Since this can correctly position the solid lubricant 21 with respect to the brush roller 22, the solid lubricant 21 may be prevented from being tilted toward the width direction thereof and from being unevenly consumed, so that the solid lubricant 21 can effectively be used until the end of its life.

Further, according to at least one exemplary embodiment of the present invention, the protruding portions 72 having a semi-cylindrical shape may be located lateral to the end portion of the solid lubricant 21. With this structure, even when the lubricant supporting unit 24 having the solid lubricant 21 thereon moves up to the brush roller 22 as the solid lubricant 21 is consumed, the lubricant supporting unit 24 may not interfere or collide with the brush roller 22.

The lubricant supporting unit 24 may have optimal dimensions. For example, the lubricant supporting unit 24 in at least one exemplary embodiment of the present invention may have a length of approximately 320 mm, a height of approximately 6 mm, and a width of approximately 8 mm. With the above-described dimensions, the protruding portion 71 formed on the end face of the slide member 70 to face the end portion of the lubricant supporting unit 24 may have a diameter of approximately 2 mm, and a height of its protrusion of approximately 0.5 mm. However, the lubricant supporting unit 24 according to at least one exemplary embodiment of the present invention may not be limited as described above. The present invention can apply the lubricant supporting unit 24 having other dimensions different from the above-described dimensions.

It is preferable that these protruding portions 71 and 72 are integrally formed in the slide member 70 that is mounted at the end portion of the lubricant supporting unit 24 and is detachably engaged with the main body 24*a* of the lubricant supporting unit 24. The integration of the protruding portions 71 and 72 may make the forming process of the slide member 70 simplified and can reduce the production cost.

Figure 11A:
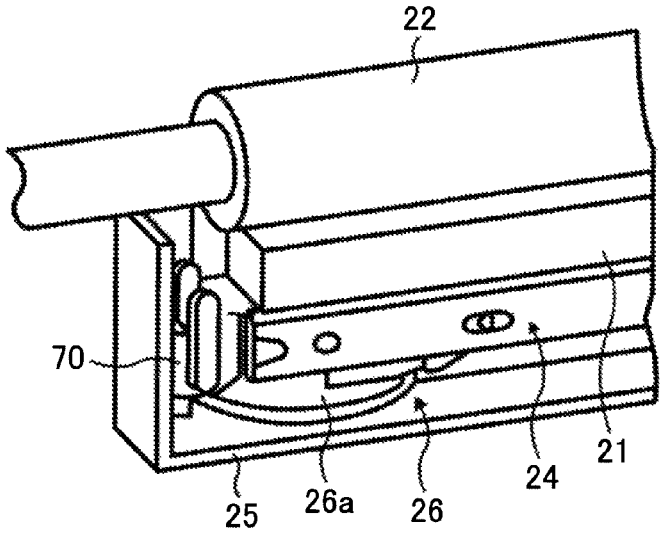
FIGS. 11A, 11B, and 11C are partial views of a lubricant holder provided in the lubricant applying unit of FIG. 8 with the lubricant supporting member of FIGS. 10A through 10D mounted on the lubricant holder, when a solid lubricant mounted on the lubricant supporting member is unused.
Figure 11B:
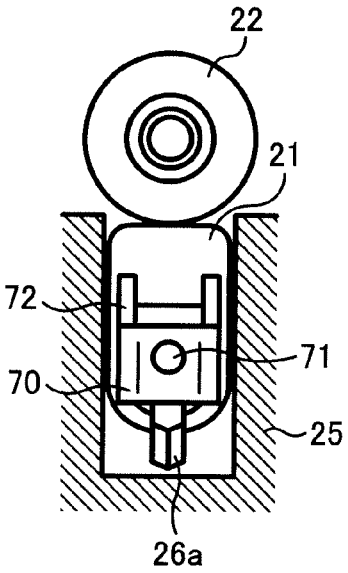
Figure 11C:
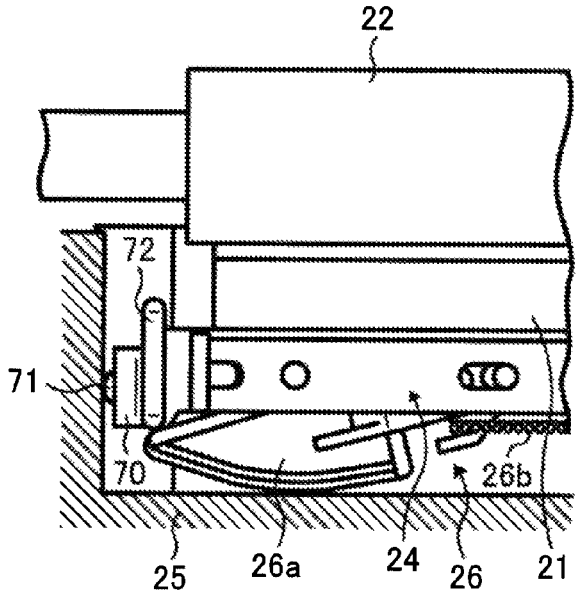
Figure 11D:
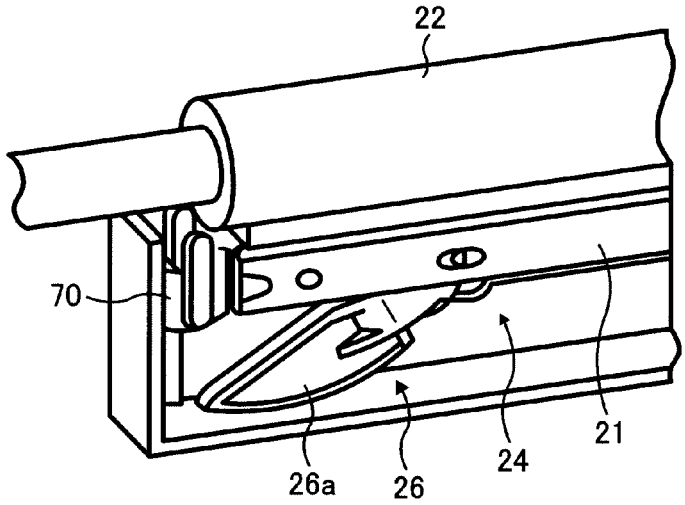
FIGS. 11D, 11E, and 11F are partial views of the lubricant holder and the lubricant supporting member of FIGS. 11A through 11C, when the solid lubricant mounted on the lubricant supporting member is consumed.
Figure 11E:
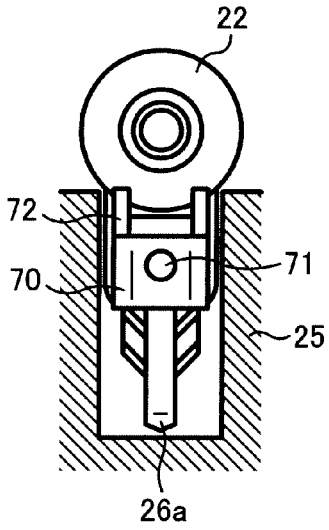
Figure 11F:
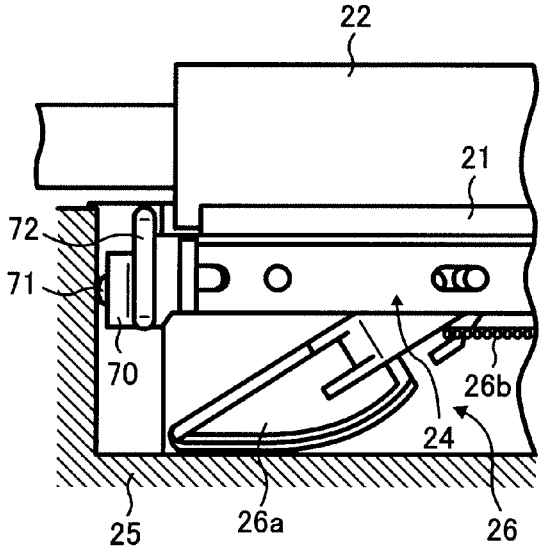

FIGS. 11A through 11F show conditions and operations of the lubricant supporting unit 24 that includes the solid lubricant 21 supported thereby and that is placed in the lubricant holder 25. FIGS. 11A and 11D are perspective views of the lubricant supporting unit 24 with a portion thereof is opened. FIGS. 11B and 11E are cross sectional views that are cut along a direction perpendicular to the axial direction of the lubricant supporting unit 24. FIGS. 11C and 11F are partial cross sectional views that are viewed along the axial direction of the lubricant supporting unit 24. Further, FIGS. 11A, 11B, and 11C show the state of the lubricant supporting unit 24 at the start of an image forming operation of the image forming apparatus 100, and FIGS. 11D, 11E, and 11F show the state of the lubricant supporting unit 24 after a predetermined period of time has elapsed from the start of the image forming operation. In other words, FIGS. 11D, 11E, and 11F show the state of the lubricant supporting unit 24 when a small amount of the solid lubricant 21 is left after a use or consumption thereof for a predetermined period of time.

With reference to FIGS. 11A through 11F, functions of the pressing mechanism 26 that may press the lubricant supporting unit 24 and the solid lubricant 21 supported by the lubricant supporting unit 24 thereon against the brush roller 22 are also described according to at least one exemplary embodiment of the present invention.

As previously described, the pressing mechanism 26 may include the pair of cams 26*a* and a spring 26*b*.

As shown in FIGS. 11A and 11C, the pair of cams 26*a* may be mounted on a bottom surface of the lubricant supporting unit 24, which is an opposite surface on which the solid lubricant 21 is mounted.

The pair of cams 26*a* may be connected by the spring 26*b* disposed therebetween to provide a predetermined distance. The spring 26*b* may serve as a biasing member and include a coil spring.

When either one of the pair of cams 26*a* is not shown, like in FIGS. 11A through 11F, the pair of cams 26*a* are described in a singular form as a "cam 26*a*." However, it is noted that both of the pair of cams 26*a* have the identical structures and functions.

As described above, the spring 26*b* disposed between the pair of cams 26*a* may serve as a biasing member to exert a restoring force that pulls the pair of cams 26*a* toward the spring 26*b* and causes the distance between the pair of cams 26*a* to become narrower. This restoring force of the spring 26*b* may cause the pair of cams 26*a* to gradually rise to an upward direction as the solid lubricant 21 is scraped by the brush roller 22 and applied to the surface of the photoconductor 10. The rise of the pair of cams 26 may cause the cam 26 to press the contact surface of the lubricant holder 25 in the upward direction. The above-described action may produce a reaction force to press the lubricant supporting unit 24 supporting the solid lubricant 21 thereon in the upward direction. Thus, the solid lubricant 21 can be held in contact with the brush roller 22 at a contact amount of pressure force.

Since FIGS. 11A, 11B, and 11C show the state of the lubricant supporting unit 24 at the start of image forming operation, the solid lubricant 21 has not been sufficiently scraped or consumed, thereby the cam 26*a* has not sufficiently risen yet.

As shown in FIGS. 11D, 11E, and 11F, the solid lubricant 21 has been consumed after the predetermined period of time from the start of the image forming operation. As the solid lubricant 21 is being consumed, the cam 26*a* may gradually rise due to the restoring force exerted by the spring 26*b*, which may cause the lubricant supporting unit 24 having the solid lubricant 21 thereon to move in the upward direction as shown in FIGS. 11D, 11E, and 11F. During the above-described movement, the contact pressure of the solid lubricant 21 against the brush roller 22 may be maintained to substantially the same amount as provided in the condition shown in FIGS. 11A, 11B, and 11C, for example.

Accordingly, the solid lubricant 21 may uniformly be held in press contact with the brush roller 22 in the longitudinal and width directions of the solid lubricant 21, and may be evenly consumed in a stable amount.

When the lubricant supporting unit 24 having the solid lubricant 21 thereon moves in the upward direction in FIGS. 11D, 11E, and 11F, the lubricant supporting unit 24 may contact and slide on the internal surface 27 of the lubricant holder 25. As previously described, the protruding portion 71 having a semicircular arc shape may be mounted on the end face of the slide member 70 attached to the lubricant supporting unit 24. Therefore, the frictional resistance that can be produced between the lubricant supporting unit 24 and the internal surface 27 of the lubricant holder 25 can be reduced or prevented, if possible. To reduce or prevent the frictional resistance, the contact portion between the end portions of the lubricant supporting unit 24 and the corresponding end portions of the internal surface 27 of the lubricant holder 25 may be kept in the point contact manner.

As previously described, the slide member 70 may be detachably engaged with the end portion of the lubricant supporting unit 24. Specifically, the two slide members 70, only one of which is not shown in FIGS. 11A through 11F, may be engaged at both end portions of the lubricant supporting unit 24 in the longitudinal direction thereof. The slide member 70 may include the respective side faces on its left and right hand side, and the protruding portions 72 having a semi-cylindrical shape may be formed on the respective side faces of the slide member 70. The protruding portions 72 may have the ridge line that extends in the sliding direction toward the bottom surface of the lubricant holder 25. Therefore, the lubricant supporting unit 24 may be held in contact with the internal surface 27 of the lubricant holder 25 in the line contact manner.

The slide members 70, each of which having the protruding portion 71 in the form of a semicircular arc shape and the protruding portions 72 in the form of a semi-cylindrical shape, may be disposed at both longitudinal ends of the lubricant supporting unit 24. Therefore, the sliding contact portion of the lubricant supporting unit 24 and the lubricant holder 25 may be kept in point or line contact. Thereby, the sliding contact portions at which frictional resistance may be produced may be evenly distributed in the longitudinal and width directions, and the amount of frictional resistance at the sliding contact portions may become small. With the above-described structure, the lubricant supporting unit 24 may move evenly in the upward direction as shown in FIGS. 11A through 11F along with the consumption of the solid lubricant 21, and the solid lubricant 21 may be held in contact with the brush roller 22 at a constant amount of pressure so that the entire surface of the solid lubricant 21 can be equally scraped or consumed. This can help apply a stable amount of lubricant to the surface of the photoconductor 10, and reduce or prevent, if possible, contamination to adjacent units and/or members due to the application of an excess amount of lubricant. Further, this can also reduce or prevent, if possible, the filming that may be caused due to adhesion or attachment of toner to the surface of the photoconductor 10 when the amount of lubricant to be applied to the photoconductor 10 is not sufficient.

The above-described effects may become greater according to a synergistic effect that can be generated with use of the SUS plate 80 disposed on the sliding contact portion of the internal surface 27 of the lubricant holder 25 with respect to the protruding portions 71 and 72 formed on the slide member 70 detachably engaged with the lubricant supporting unit 24.

The functions and structures of the SUS plate 80 will be described later.

As shown in FIGS. 2 and 3, the lubricant applying unit 20, which may include the lubricant supporting unit 24 engaged with the slide members 70 having the protruding portions 71 and 72 formed thereon and the lubricant holder 25 having the SUS plates 80 on the internal surface 27 in the vicinity of the end portions of the lubricant holder 25, may be provided in the process cartridge 121. In the process cartridge 121, the photoconductor 10 and, for example, at least one of the cleaning unit 30, the charging unit 40, and the developing unit 50 are integrally mounted therein. The process cartridge 121 may be provided in the image forming apparatus 100, as shown in FIG. 1, so as to perform the image forming operations.

As described above, the lubricant applying unit 20 having a plurality of frictional resistance reducing portions may be provided in the process cartridge 121. Thereby, the image forming components such as the solid lubricant 21 can easily be maintained and replaced.

As previously described, during the image forming operation, the lubricant applying unit 20 may apply lubricant on the surface of the photoconductor 10 after the cleaning unit 30 has removed the residual toner from the photoconductor 10. Specifically, as shown in FIGS. 11A through 11F, the brush roller 22 may be held in contact with both the solid lubricant 21 and the photoconductor 10 (not shown in FIGS. 11A through 11F) and be rotated therebetween. The brush roller 22 may scrape the top surface of the solid lubricant 21, and the scraped lubricant in a powder form may be applied to the surface of the photoconductor 10.

At this time, the protruding portion 71 may be formed on the end face of the slide member 70 detachably engaged with the end portion of the lubricant supporting unit 24, and the protruding portions 72 may be formed on the side faces of the slide member 70. Therefore, the lubricant supporting unit 24 may be held in contact at the sliding contact portion with the internal surface 27 of the lubricant holder 25 in the point or line contact manner. Accordingly, the frictional resistance produced at the sliding contact portion may be reduced. Thus, the lubricant supporting unit 24 may smoothly slide thereon. By smoothly moving the lubricant supporting unit 24, the amount of contact pressure of the solid lubricant 21 with respect to the brush roller 22 may be evenly or uniformly provided in the longitudinal direction of the solid lubricant 21.

Further, the protruding portions 72 having a semi-cylindrical shape may be extended in the upward direction beyond the upper surface of the lubricant supporting unit 24. As the solid lubricant 21 is consumed, the lubricant supporting unit 24 having the solid lubricant 21 thereon may be pushed in the upward direction. While being pushed up, the solid lubricant 21 may stably be supported by the protruding portions 72 formed on both side faces of the slide member 70 detachably engaged with the lubricant supporting unit 24 in the longitudinal direction thereof. Therefore, the solid lubricant 21 may not be tilted toward the rotation direction of the brush roller 22. Furthermore, the protruding portions 72 may be kept in a correct position with respect to the brush roller 22 so that the entire contact surface of the solid lubricant 21 can be scraped or consumed evenly. This may stabilize the amount of lubricant used for the surface of the photoconductor 10, and prevent contamination to the adjacent units such as the charging unit 40 due to an excess amount of lubricant applied. In addition, as previously described, this can also reduce or prevent, if possible, the filming that may be caused due to adhesion of toner to the surface of the photoconductor 10 when the amount of lubricant to be applied to the photoconductor 10 is not sufficient.

The lubricant regulating blade 23 disposed at the downstream side thereof may regulate the lubricant applied in a powder form on the surface of the photoconductor 10 to have a predetermined height. The photoconductor 10 having the regulated lubricant applied on the surface thereof may uniformly be charged to the predetermined polarity by the charging roller 41 of the charging unit 40. Thus, the above-described image forming operations may be repeated.

As described above, the lubricant supporting unit 24 may include the main body 24*a* thereof serving as a lubricant carrying member and the slide member 70 that is detachably engaged with the corresponding end portion of the lubricant supporting unit 24. Thereby, each function thereof may separately be operated, which can enhance the quality of the lubricant applying unit 20.

In addition, the above-described process cartridge 121 may be provided in the image forming apparatus 100. Thereby, a stable amount of lubricant may be applied to the surface of the photoconductor 10, and the contamination to the adjacent units such as the charging unit and the filming due to adhesion of toner may be prevented. Therefore, images having high quality can stably be produced for a long period of time.

According to at least one exemplary embodiment of the present invention, the solid lubricant 21 including zinc stearate (ZnSt) is preferably used. However, the present invention can alternatively use a lubricant including calcium stearate (CaSt) or other material.

Further, the brush roller 22 is preferably used. However, the present invention can be applied to other types of a lubricant applying member, such as a sponge roller, a non-woven roller, a fur brush roller, and so forth.

According to at least one exemplary embodiment of the present invention, it is preferable that a friction coefficient "μt" of the main body 24*a* of the lubricant supporting unit 24, and a friction coefficient "μs" of the slide member 70 detachably engaged with the end portion thereof, have a relationship of "μt>μs." Thereby, respective appropriate materials may be applied to the corresponding members, and, for example, the optimal sliding ability of the lubricant supporting unit 24 with respect to the lubricant holder 25 and the optimal maintainability of the solid lubricant 21 may be obtained.

In at least one exemplary embodiment of the present invention, the protruding portion 71 may be formed on the end face of the slide member 70 that is detachably engaged with the end portions of the lubricant supporting unit 24 in the longitudinal direction, and the protruding portions 72 may be formed on the side faces of the slide member 70 detachably engaged with the predetermined side surfaces in the vicinity of the end portions of the lubricant supporting unit 24. However, the present invention is not limited to the above-described positions but can apply a friction resistance reducing member that is arranged only on the end portion of the lubricant supporting unit 24 in the longitudinal direction thereof, or only on at least one of the predetermined side surfaces of the lubricant supporting unit 24 in the vicinity of the end portions thereof. Or a friction resistance reducing member serving as a frictional resistance reducing portion can be mounted on the internal surface of the lubricant holder 25.

Figure 12:
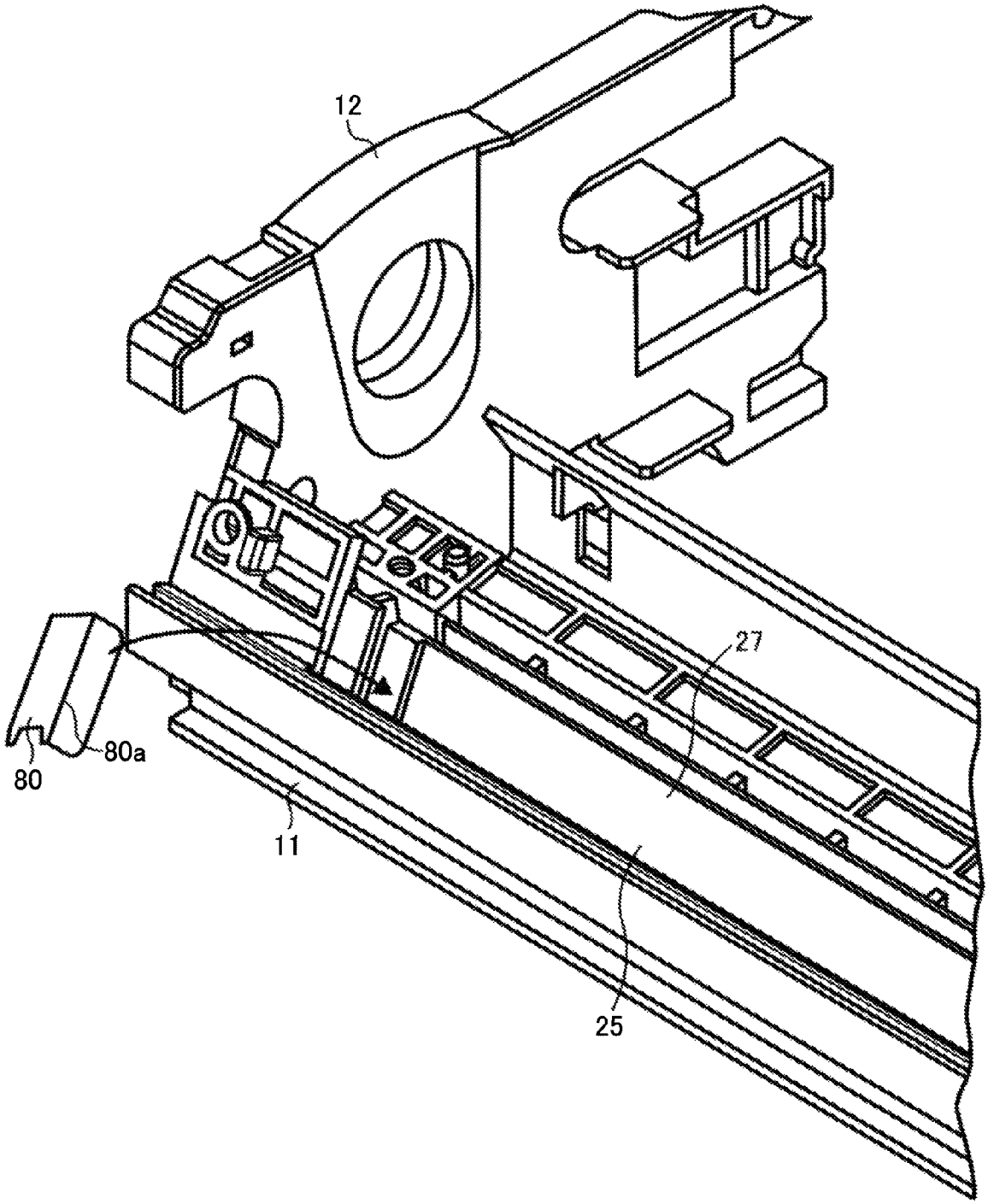
FIG. 12 is a partial view showing one end portion of a housing of the process cartridge according to at least one exemplary embodiment of the present invention.
Figure 13:
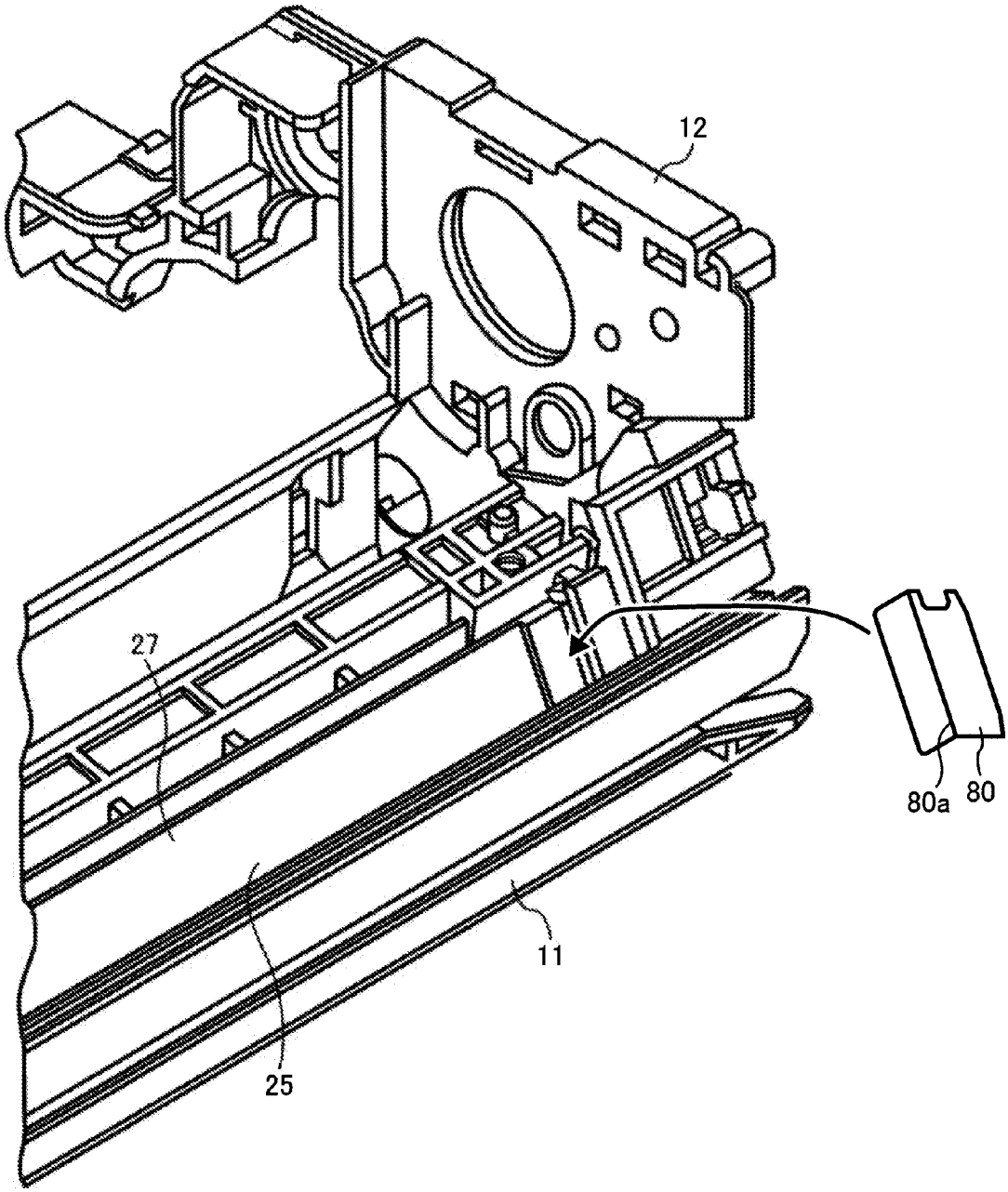
FIG. 13 is a partial view showing the other end portion of the housing of the process cartridge of FIG. 12.

Referring to FIGS. 12 and 13, details of the SUS plate 80 according to at least one exemplary embodiment of the present invention are described.

FIG. 12 shows an enlarged view of one end of the housing 11 of the process cartridge 121, and FIG. 13 shows an enlarged view of the other end of the housing 11 of the process cartridge 121, which is an opposite end of the process cartridge 121 shown in FIG. 12.

As shown in FIG. 12, one of the SUS plates 80 may be disposed at an end portion of the lubricant holder 25 of the housing 11 of the process cartridge 121, such that the SUS plate 80 serving as a frictional resistance reducing member may face an end portion of the lubricant supporting unit 24 (shown in FIG. 8) or may face a portion in the vicinity of the end portion of the lubricant supporting unit 24.

Further, as shown in FIG. 13, the other of the SUS plates 80 may also be disposed at the other end portion of the lubricant holder 25 of the housing 11 of the process cartridge 121 with the same condition as the SUS plate 80 of FIG. 12. That is, the SUS plates 80 may cover the short sides of the lubricant holder 25 of FIGS. 12 and 13 and the predetermined portions on the internal surface 27 at the downstream side of the lubricant applying brush roller 22.

As described above, the SUS plates 80 may be disposed on the lubricant holder 25 at the respective sliding contact portions, each of which is a predetermined portion located in the vicinity of the end of the lubricant holder 25 where the lubricant supporting unit 24 may contact therewith in the longitudinal direction of the lubricant holder 25. Thereby, the lubricant supporting unit 24, including a resin material such as a polyacetal resin mixed with a filler as a hardening agent, may not directly be held in sliding contact with the internal surface 27 of the lubricant holder 25, and the frictional resistance produced on the sliding contact portion between the lubricant supporting unit 24 and the internal surface 27 of the lubricant holder 25 can be remarkably reduced.

Accordingly, the pair of cams 26*a* and the spring 26*b* that may be disposed between the pair of cams 26*a* may uniformly press the lubricant supporting unit 24 to the brush roller 22 in the longitudinal direction of the solid lubricant 21. Thereby, the lubricant supporting unit 24 may be raised in the upward direction so that the entire contact surface of the solid lubricant 21 can be held evenly in contact with the brush roller 22. This may prevent an uneven wear of the solid lubricant 21 and may cause the solid lubricant 21 to be evenly scraped. With the above-described structure, the consumption amount of lubricant may become stable. Additionally, the filming caused due to the application of a small amount of lubricant on the surface of the photoconductor 10 and the contamination to the adjacent units caused due to the application of an excess amount of lubricant may be reduced or terminated.

The SUS plates 80 according to at least one exemplary embodiment of the present invention may be disposed at both end portions of the lubricant holder 25. However, the position of each of the SUS plates 80 is not limited as described above. Alternatively, the SUS plates 80 may be arranged to cover the entire portion of the internal surface 27 at the downstream side of the lubricant holder 25. The above-described SUS plate 80 can obtain substantially the same effect in reducing the frictional resistance as the SUS plates 80 that may separately be disposed at both end portions of the lubricant holder 25 to partially cover the respective predetermined portions of the internal surface 27 at the downstream side of the lubricant holder 25.

Figure 14A:
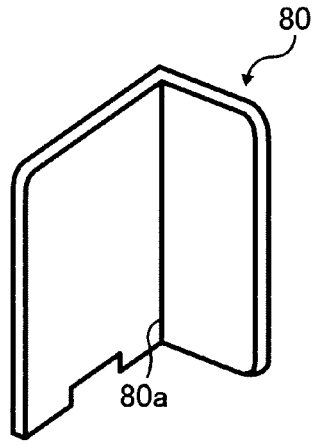
FIG. 14A is a perspective view of a SUS plate mounted on the lubricant holder.
Figure 14B:
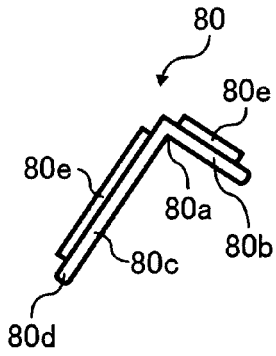
FIG. 14B is a top view of the SUS plate of FIG. 14A.

The SUS plate 80 may include a folding portion 80*a* (see FIGS. 14A and 14B for details).

Table 1 shows coefficients of dynamic friction produced between a polyacetal material that is a main element of the lubricant supporting unit 24 and various materials. The coefficients of dynamic friction were measured with a test under the test method of the American Society for Testing and Materials (ASTM) and the waist over type (radial type).

TABLE 1

| | Sliding Contact Material: Polyacetal Material vs. | Coefficients of Dynamic Friction |
|---|---|---|
| 1 | Stainless Steel | 0.13 |
| 2 | Steel | 0.13 |
| 3 | Brass | 0.15 |
| 4 | Aluminum | 0.15 |
| 5 | Polyacetal Material | 0.20 |

Table 1 shows that the coefficient of friction produced at the sliding contact portion between the polyacetal material and a metal material may become smaller by approximately 25%, while the coefficient of friction produced at the sliding contact portion between the polyacetal materials may be 0.20. Especially when a stainless steel (SUS) is used as a metal material, the coefficient of dynamic friction thereof may be 0.13, which is substantially the same as the coefficient of dynamic friction with respect to a steel material but is twice as strong as a general zinc coated steel plate. Therefore, the SUS plate 80 may be preferably used in an extending manner along and beyond the internal surface 27 of the lubricant holder 25, as shown in at least one exemplary embodiment of the present invention.

Further, it is also reported that a 0.05 coefficient of dynamic friction was obtained between the stainless steel and the polyacetal material in a different testing method.

Therefore, in at least one exemplary embodiment of the present invention, it is preferable to provide the SUS plate 80 to serve as a frictional resistance reducing member on the sliding contact portion between the lubricant supporting unit 24 and the lubricant holder 25.

Here, the frictional resistance reducing member represents a member that may be disposed at the sliding contact portion of the lubricant supporting unit 24 and the internal surface 27 of the lubricant holder 25 and may reduce a coefficient of friction at the sliding contact portion between the lubricant supporting unit 24 and the internal surface 27 of the lubricant holder 25 to become smaller than the coefficient of friction produced when the polyacetal resins contact in a sliding manner.

In at least one exemplary embodiment of the present invention, it is preferable to provide the SUS plate 80 in which the coefficient of friction between the lubricant supporting unit 24 and the internal surface 27 of the lubricant holder 25 may become 0.15 or smaller.

Referring to FIGS. 14A and 14B, details of the SUS plate 80 serving as a frictional resistance reducing member according to at least one exemplary embodiment of the present invention are described.

FIG. 14A is a perspective view of the SUS plate 80, and FIG. 14B is a top view of the SUS plate 80.

As shown in FIG. 14A, the SUS plate 80 may include the folding portion 80*a* that has a L-shaped cross section in a direction perpendicular to the sliding direction of the solid lubricant 21. The folding portion 80*a* may connect two adjacent surfaces of the SUS plate 80. That is, as shown in FIG. 14B, a short side 80*b* and a long side 80*c* of the SUS plate 80 may cross each other at right angles at the folding portion 80*a* in a direction perpendicular to the sliding direction of the solid lubricant 21. The long side 80*c* may include an end portion 80*d* that serves as a supporting point.

The length of the long side 80*c* may correspond to the short side of the lubricant holder 25 or may be substantially the same length as a width of the end portion of the inner surface 27 of the lubricant holder 25. That is, the length of the long side 80*c* may be approximately 8 mm, for example.

On the other hand, the length of the short side 80*b* may correspond to a distance that covers the end portion of the internal surface 27 at the downstream side of the lubricant holder 25. The above-described distance may be in a range, for example, from approximately 3 mm to approximately 15 mm, preferably from approximately 8 mm to approximately 12 mm.

When the above-described width of the SUS plate 80 is less than 3 mm, the effect to reduce the frictional resistance may not be sufficient. Further, when the width of the SUS plate 80 is 15 mm or greater, the effect to reduce the frictional resistance may not show any further change. By having the folding portion 80*a*, the mechanical strength of the SUS plate 80 may increase.

A cut section at the end portion of the SUS plate 80 may be called as a burred surface (BS surface). The burred surface of the SUS plate 80 may be arranged to face an adhesion layer 80*e*, which may be located at the side of the internal surface 27 of the lubricant holder 25. This arrangement of the burred surface of the SUS plate 80 may reduce a disturbance caused due to the burred surface that may affect the sliding movement of the lubricant supporting unit 24.

If the burred surface of the SUS plate 80 is arranged to face the sliding contact side of the lubricant supporting unit 24, the burred surface may cause damage by sticking to the surfaces of the lubricant supporting unit 24 when the lubricant supporting unit 24 that includes a resin material moves in a sliding contact manner with the SUS plate 80. As a result, a smooth sliding performance in a sliding contact manner cannot be obtained.

Figure 15:
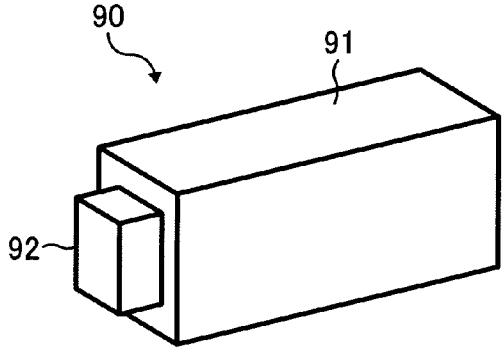
FIG. 15 is a perspective view of an attaching jig for attaching the SUS plate to the lubricant holder.

Referring to FIG. 15, an attachment jig 90 for mounting the SUS plate 80 on the lubricant holder 25 is described.

The attachment jig 90 shown in FIG. 15 may be an example of an attaching tool used for mounting the SUS plate 80 on the lubricant holder 25 at the end portion thereof. The attachment jig 90 may include a block-shaped main body 91 and an adhesive elastic layer part 92.

The block-shaped main body 91 may be formed in a rectangular solid shape and include a plastic material.

The adhesive elastic layer part 92 may include a resin material and be mounted on one end surface in the longitudinal direction of the block-shaped main body 91.

Figure 16A:
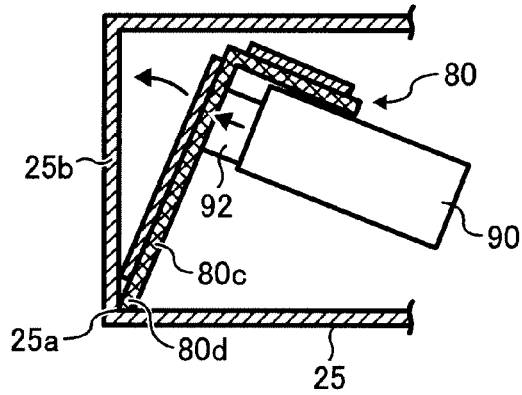
FIGS. 16A, 16B, and 16C are schematic views for attaching the SUS plate to the lubricant holder.
Figure 16B:
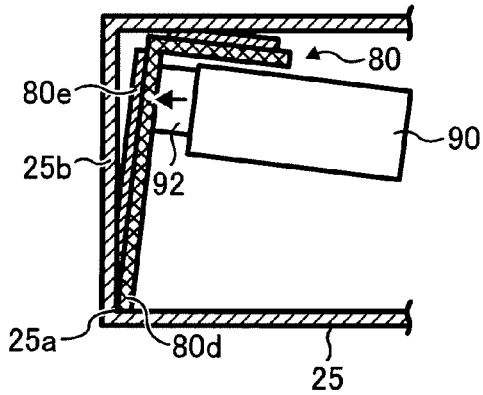
Figure 16C:
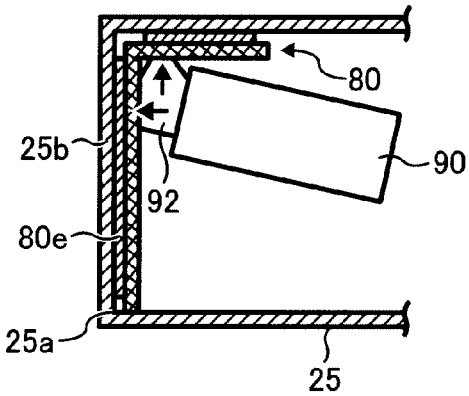

Referring to FIGS. 16A, 16B, and 16C, procedures of attaching the SUS plate 80 to the lubricant holder 25 by using the attachment jig 90 are described.

FIGS. 16A, 16B, and 16C are top cross sectional views of the lubricant holder 25.

To start the operation of attaching the SUS plate 80 to the lubricant holder 25, the adhesive elastic layer part 92 of the attachment jig 90 shown in FIG. 15 may be pressed to adhere to an internal surface of the SUS plate 80 at the long side 80*c* adjacent to the folding portion 80*a* so that the end portion 80*d* of the long side 80*c* of the SUS plate 80 can be held in contact with a medial angle at the end portion of the lubricant holder 25, as shown in FIG. 16A.

Then, the attachment jig 90 may be pressed to the left side in FIG. 16A, which is in a direction indicated by an arrow in FIG. 16A. As shown in FIG. 16B, the attachment jig 90 may be pivotably moved centering around the end portion 80*d*, which serves as a supporting point, of the long side 80*c* of the SUS plate 80, which may be held in contact with the medial angle 25*a* at the end portion of the lubricant holder 25.

As the attachment jig 90 is pressing the SUS plate 80, the long side 80*c* of the SUS plate 80 may also contact and adhere to an end surface 25*b* of the lubricant holder 25 with the adhesion layer 80*e* therebetween, as shown in FIG. 16C.

At this time, the adhesive elastic layer part 92 may receive not only a pressure force exerted by the attachment jig 90 to the left side on FIG. 16C, but also a pressure force to auxetically press the SUS plate 80 in an upward direction. Therefore, the short side 80*b* and the long side 80*c* of the SUS plate 80 may contact respective predetermined portions of the lubricant holder 25 to be adhered by the adhesive elastic layer part 80*e*.

As shown in FIG. 5, the SUS plate 80 may be extended in the upward direction along the internal surface 27 at the downstream side of the lubricant holder 25, beyond the height of the internal surface 27 and to the vicinity of the brush roller 22. The above-described arrangement of the SUS plate 80 may cause the height of the internal surface 27 at the downstream side of the lubricant holder 25 to become substantially the same as the height of an internal surface 28 of the lubricant holder 25, which is located at the upstream side of a rotation of the brush roller 22. That is, respective distances of the internal surfaces 27 and 28 of the lubricant holder 25 from the brush roller 22 may become substantially the same. Therefore, as the solid lubricant 21 is being consumed, the lubricant supporting unit 24 that may support and mount the solid lubricant 21 thereon may be pushed toward the brush roller 22 and may be supported by the internal surfaces 27 and 28 at the upstream and downstream sides of the lubricant holder 25 until the solid lubricant 21 is completely consumed.

Accordingly, the lubricant supporting unit 24 can be disposed at a correct position with respect to the brush roller 22 without tilting the position. This may cause the solid lubricant 21 to be evenly used, and thereby the lubricant in a powder form scraped from the solid lubricant 21 may stably be applied to the surface of photoconductor 10.

As described above, the lubricant applying unit 20 may include the lubricant holder 25 with the SUS plates 80 mounted on both end portions in the longitudinal direction thereof. As shown in FIGS. 2 and 3, the above-described lubricant applying unit 20 having the SUS plates 80 mounted on the internal surface 27 of the lubricant holder 25 may be integrally provided to the process cartridge 121.

According to at least one exemplary embodiment, the SUS plate 80 that serves as a frictional resistance reducing member may be mounted on a sliding contact portion between the lubricant supporting unit 24 that supports the solid lubricant 21 and the internal surface 27 at the downstream side of the lubricant holder 25. This can reduce a frictional resistance when the lubricant supporting unit 24 moves in a sliding contact manner with the internal surface 27 of the lubricant holder 25. Thereby, a better sliding performance between the lubricant supporting unit 24 and the internal surface 27 of the lubricant holder 25 may be obtained, and the solid lubricant 21 may be evenly pressed by the brush roller 22, which may result in reducing or preventing, if possible, an uneven wear of the solid lubricant 21. Therefore, a stable amount of lubricant may be applied to the surface of the photoconductor 10, and the solid lubricant 21 can effectively be applied until the solid lubricant 21 is completely used up. Further, this may prevent the contamination to the adjacent units caused due to an excess amount of lubricant scraped from the solid lubricant 21 and the filming caused due to a small amount of lubricant.

According to at least one exemplary embodiment, the SUS plate 80 may be arranged beyond the upper end portion of the internal surface 27 at the downstream side of the lubricant holder 25 so as to extend closer to the brush roller 22. Thereby, the SUS plate 80 can support the solid lubricant 21 so as not to be tilted to the rotation direction of the brush roller 22, which can reduce or prevent an uneven wear of the solid lubricant 21. Therefore, the solid lubricant 21 can effectively be applied until the solid lubricant 21 is completely used up. Further, in at least one exemplary embodiment of the present invention, a tilting angle of the lubricant supporting unit 24 to the internal surface 27 of the lubricant holder 25 can be 3 degrees or less, for example.

According to at least one exemplary embodiment of the present invention, the SUS plate 80 may be mounted on the internal surface 27 of the lubricant holder 25, opposite to the vicinity of both end portions in the longitudinal direction of the lubricant supporting unit 24. Thereby, the sliding performance between the lubricant holder 25 and the lubricant supporting unit 24 may be enhanced with a small number of materials and a relatively simple structure, and problems related to poor sliding performance can be solved.

Further, the SUS plate 80 may include a sheet-like frictional resistance reducing member. This can obtain a sufficient strength without requiring space for the frictional resistance reducing member. The SUS plate 80 can easily be attached to the housing 11 of a ready made process cartridge to enhance a sliding performance of the lubricant supporting unit 24. Further, since the burred surface of the SUS plate 80 may be arranged to face the internal surface 27 of the lubricant holder 25, the burred surface may not stick to the sliding contact surface of the lubricant supporting unit 24, which can obtain a better sliding performance.

Further, according to at least one exemplary embodiment of the present invention, since the SUS plate 80 may include the folding portions 80*a*, the mechanical strength of the SUS plate 80 can be further increased. The number of folding portion 80*a* is not limited, but can be two or more portions. However, a simple manufacturing process and an enhancement of the mechanical strength of the SUS plate 80 are required. For example, when the end portion 80*d* of the long side 80*c* is folded, the mechanical strength of the long side 80*c* can be obtained.

In the above-described at least one exemplary embodiment of the present invention, the process cartridge 121 may be installed by mounting the solid lubricant 21, the SUS plate 80, the brush roller 22, and so forth on the housing 11. At the beginning of the installation of the process cartridge 121, the respective SUS plates 80 may be mounted at the corresponding end portions of the lubricant holder 25 of the housing 11. Next, the lubricant supporting unit 24 with the solid lubricant 21 integrally supported and mounted thereon may be placed onto the lubricant holder 25. Then, the brush roller 22 may be disposed between the pair of side plates 12.

Further, in at least one exemplary embodiment of the present invention, the burred surface of the SUS plate 80 may be arranged to face the internal surface 27 of the lubricant holder 25. However, the end portion of the SUS plate 80, especially in the vicinity of the brush roller 22, can alternatively be folded toward the internal surface 27 of the lubricant holder 25 so that the burred surface of the SUS plate 80 may not protrude to the sliding contact portion with the lubricant supporting unit 24. With the above-described structure, the same effect as the state in which the burred surface of the SUS plate 80 is arranged at the side of the internal surface 27 of the lubricant holder 25 may be obtained. In this case, a hemming can be applied to the folding shape. The hemming may further enhance the mechanical strength at the end portion of the SUS plate 80.

Further, in at least one exemplary embodiment of the present invention, when the SUS plate 80 that serves as a frictional resistance reducing member is attached to the end portion of the lubricant holder 25 in the housing 11 of the process cartridge 121, it is preferable to use the attachment jig 90. By using the attaching attachment jig 90, any user, even an inexperienced person, can easily attach the SUS plate 80 to the lubricant holder 25.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed as new and desired to be secured by Letters Patent of the United States is:

1. A lubricant applying unit, comprising:

a solid lubricant;

a lubricant supporting unit configured to support the solid lubricant;

a lubricant holder configured to accommodate the solid lubricant supported by the lubricant supporting unit;

a pressing mechanism disposed between the lubricant supporting unit and the lubricant holder, the pressing mechanism configured to press the solid lubricant against a lubricant applying member; and a frictional resistance reducing member mounted on an internal surface of the lubricant holder, wherein the lubricant supporting unit comprises a lubricant mounting surface on which the solid lubricant is mounted and a lubricant holder facing surface disposed facing an internal surface of the lubricant holder, and the frictional resistance reducing member reduces a frictional resistance produced at sliding contact portions between the lubricant holder facing surface of the lubricant supporting unit and the internal surface of the lubricant holder.

2. The lubricant applying unit according to claim 1, wherein:

the frictional resistance reducing member includes protruding portions disposed to at least one of the lubricant supporting unit and the lubricant holder.

3. The lubricant applying unit according to claim 1, wherein:

the frictional resistance reducing member includes protruding portions and is disposed to at least one of end portions and respective side portions of the lubricant supporting unit.

4. The lubricant applying unit according to claim 3, wherein:

the frictional resistance reducing member includes a plurality of frictional resistance reducing portions, and at least one of the plurality of frictional resistance reducing portions is formed in a line shape of sequential protruding portions along a sliding direction of the lubricant holder.

5. The lubricant applying unit according to claim 4, wherein:

the frictional resistance reducing portion disposed to the end portions is provided in a point contact manner with respect to the internal surfaces of the lubricant holder, and the frictional resistance reducing portion disposed to the respective side portions is provided in a line contact manner with the sequential protruding portions, with respect to the internal surfaces of the lubricant holder along the sliding direction of the lubricant holder.

6. The lubricant applying unit according to claim 4, wherein the at least one of the plurality of frictional resistance reducing portions formed in the line shape of sequential protruding portions along the sliding direction of the lubricant holder is located laterally to end portions in an axial direction of the solid lubricant.

7. The lubricant applying unit according to claim 4, wherein the at least one of the plurality of frictional resistance reducing portions formed in the line shape of sequential protruding portions along the sliding direction of the lubricant holder is formed in a manner extending beyond an upper surface of the lubricant supporting unit and an upper surface of the lubricant holder.

8. The lubricant applying unit according to claim 1, wherein the lubricant supporting unit includes:

a lubricant bearing member including the lubricant mounting surface and configured to bear the solid lubricant thereon, and at least one slide member configured to slide on the sliding contact portions, the at least one slide member includes the at least one frictional resistance reducing portion.

9. The lubricant applying unit according to claim 8, wherein:

a friction coefficient of the lubricant bearing member "$\mu t$" and a friction coefficient of the at least one of slide members "$\mu s$" have a relationship of $\mu t > \mu s$.

10. The lubricant applying unit according to claim 8, wherein the slide member is detachably engaged with the lubricant bearing member.

11. The lubricant applying unit according to claim 2, wherein:

the protruding portions are provided on the lubricant holder, and the frictional resistance reducing member is provided at end portions of the internal surfaces of the lubricant holder.

12. The lubricant applying unit according to claim 2, wherein:

the internal surfaces of the lubricant holder include a first internal surface located at a downstream side of a rotation direction of the lubricant applying member, and the frictional resistance reducing member is mounted on the first internal surface.

13. The lubricant applying unit according to claim 12, wherein:

the internal surfaces of the lubricant holder further include a second internal surface located at an upstream side of the rotation direction of the lubricant applying member, and the first internal surface with the frictional resistance reducing member mounted thereon has substantially a same height as the second internal surface of the lubricant holder.

14. The lubricant applying unit according to claim 1, wherein the lubricant applying member includes a rotatable brush member.

15. The lubricant applying unit according to claim 11, wherein the frictional resistance reducing member includes a sheet-like metallic material.

16. The lubricant applying unit according to claim 15, wherein the sheet-like metallic material includes a burred surface to face the internal surfaces of the lubricant holder.

17. The lubricant applying unit according to claim 15, wherein the frictional resistance reducing member includes at least one folding portion having a L-shaped cross section in a direction perpendicular to a sliding direction of the solid lubricant.

18. The lubricant applying unit according to claim 17, wherein:

the frictional resistance reducing member includes first and second sides connected at right angles of the folding portion, the first side having substantially a same length as an inner width of the lubricant holder, an end portion of the first side of the frictional resistance reducing member is configured to be held in contact with a medial angle of the lubricant holder, the frictional resistance reducing member is configured to rotate with the end portion of the first side of the frictional resistance reducing member serving as a supporting point, the first side of the frictional resistance reducing member is configured to contact a side regulating the inner width of the lubricant holder, and the frictional resistance reducing member is configured to be attached to the end portion of the inner surface of the lubricant holder.

19. A process cartridge detachably attached to an image forming apparatus, the process cartridge comprising:

an image bearing member configured to bear an image thereon;

at least one of a charging unit, a developing unit, and a cleaning unit; and a lubricant applying unit, comprising a solid lubricant, a lubricant supporting unit configured to support the solid lubricant, a lubricant holder configured to accommodate the solid lubricant supported by the lubricant supporting unit, a pressing mechanism disposed between the lubricant supporting unit and the lubricant holder, the pressing mechanism configured to press the solid lubricant against a lubricant applying member at a constant amount of pressure, and a frictional resistance reducing member mounted on an internal surface of the lubricant holder, wherein the lubricant supporting unit comprises a lubricant mounting surface on which the solid lubricant is mounted and a lubricant holder facing surface disposed facing an internal surface of the lubricant holder, and the frictional resistance reducing member reduces a frictional resistance produced at sliding contact portions between the lubricant holder facing surface of the lubricant supporting unit and the internal surface of the lubricant holder.

20. An image forming apparatus, comprising:

an image bearing member configured to bear an image on a surface thereof;

a charging unit configured to uniformly charge the image bearing member;

a developing unit configured to develop an image formed on the image bearing member to a visible toner image;

a cleaning unit configured to remove residual toner on the surface of the image bearing member; and a lubricant applying unit, comprising a solid lubricant, a lubricant supporting unit configured to support the solid lubricant, a lubricant holder configured to accommodate the solid lubricant supported by the lubricant supporting unit, a pressing mechanism disposed between the lubricant supporting unit and the lubricant holder, the pressing mechanism configured to press the solid lubricant against a lubricant applying member at a constant amount of pressure, and a frictional resistance reducing member mounted on an internal surface of the lubricant holder, wherein the lubricant supporting unit comprises a lubricant mounting surface on which the solid lubricant is mounted and a lubricant holder facing surface disposed facing an internal surface of the lubricant holder, and the frictional resistance reducing member reduces a frictional resistance produced at sliding contact portions between the lubricant holder facing surface of the lubricant supporting unit and the internal surface of the lubricant holder.

* * * * *